United States Patent [19]

Brouwer et al.

[11] Patent Number: 4,458,729

[45] Date of Patent: Jul. 10, 1984

[54] STRAND DELIVERY AND STORAGE SYSTEM

[75] Inventors: Charles W. Brouwer, East Greenwich; Karl W. Wueger, Wakefield, both of R.I.

[73] Assignee: Leesona Corporation, Warwick, R.I.

[21] Appl. No.: 63,739

[22] Filed: Aug. 6, 1979

[51] Int. Cl.[3] ..... D03D 47/30

[52] U.S. Cl. ..... 139/435; 242/47.01; 139/452

[58] Field of Search ..... 139/435, 452; 242/47.01, 47.12, 47.13; 66/132 R

[56] References Cited

U.S. PATENT DOCUMENTS

| | | | |
|---|---|---|---|
| 3,229,725 | 1/1966 | Saito | 139/435 |
| 3,977,442 | 8/1976 | Shibata et al. | 139/435 |
| 4,002,190 | 1/1977 | Seucik et al. | 139/452 |
| 4,074,727 | 2/1978 | Kowk et al. | 139/435 |
| 4,079,759 | 3/1978 | Riha et al. | 139/452 |
| 4,134,435 | 1/1979 | Cornellier | 139/435 |
| 4,197,882 | 4/1980 | Ohnishi | 139/435 |

FOREIGN PATENT DOCUMENTS 52-155258 of 1977 Japan .

*Primary Examiner*—Henry Jaudon
*Attorney, Agent, or Firm*—Burnett W. Norton

[57] ABSTRACT

A strand is furnished to a strand consuming unit, e.g. loom, having a periodic demand for a finite length of strand by:

(a) continuously advancing the strand from a supply source for winding onto a first surface, (b) continuously advancing the strand from the first surface onto one end of a second surface for rewinding thereof on the second surface, (c) periodically operating the consuming unit to withdraw the strand from an opposite end of such second surface while continuing the advance of the strand both to such first surface and from the first surface toward the first end of the second surface, and (d) halting withdrawal of the strand when a finite length thereof has been withdrawn from the opposite end of the second surface by the consuming unit.

Upon the withdrawal of the finite strand length from the second surface, the strand is mechanically engaged proximate the beginning of the second surface so as to preclude additional strand from being accidentally advanced from the first surface by the tension in the withdrawing strand.

The invention also contemplates the adjustment of the conditions of the projection of the strand by the insertion nozzle for the purpose of adjusting the effective thrust applied by the nozzle to the strand so that the leading end of the pulse of air emitted by the injection nozzle always precedes the leading end of the strand being projected therefrom and bunching up of the leading strand end is thereby avoided. Ideally, the thrust applied by the nozzle to the strand and the resistance of the strand to advance are correlated so that the leading end of the strand at least substantially, and preferably precisely, coincides with the withdrawal of the final portion of the finite strand length from the second surface and thus the strand extends in a straightened out condition from the beginning of such surface through the entire shed of the loom.

74 Claims, 29 Drawing Figures

FIG. 2A.
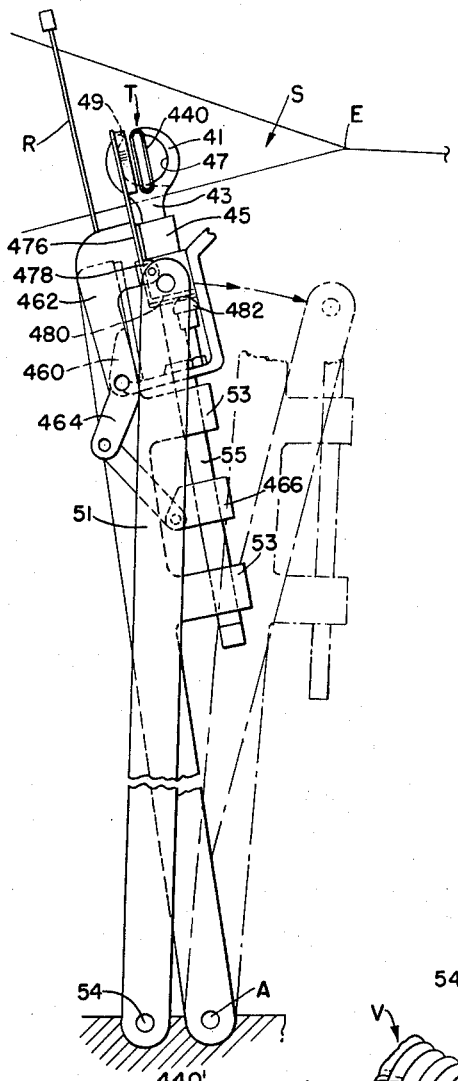
FIG. 2B
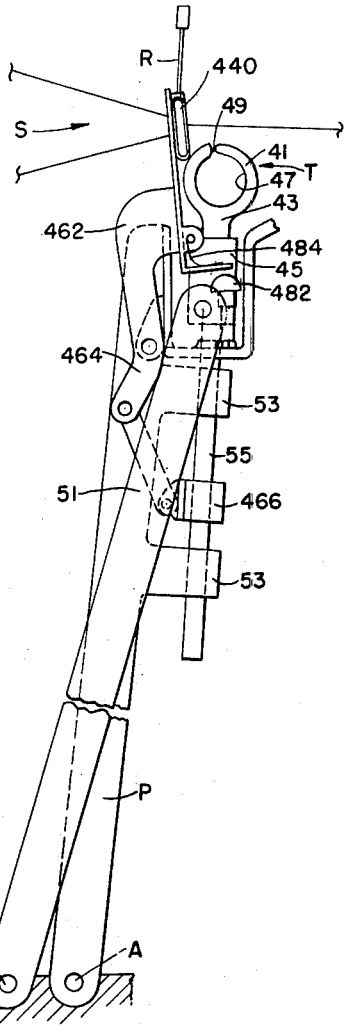
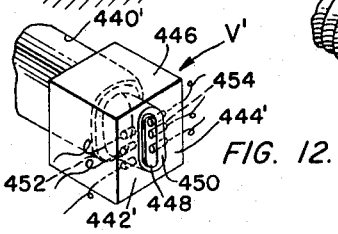
FIG. 12.
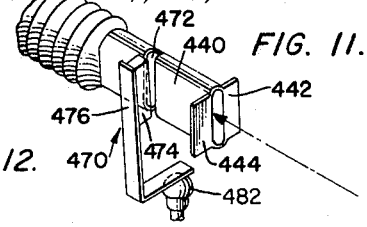
FIG. 11.

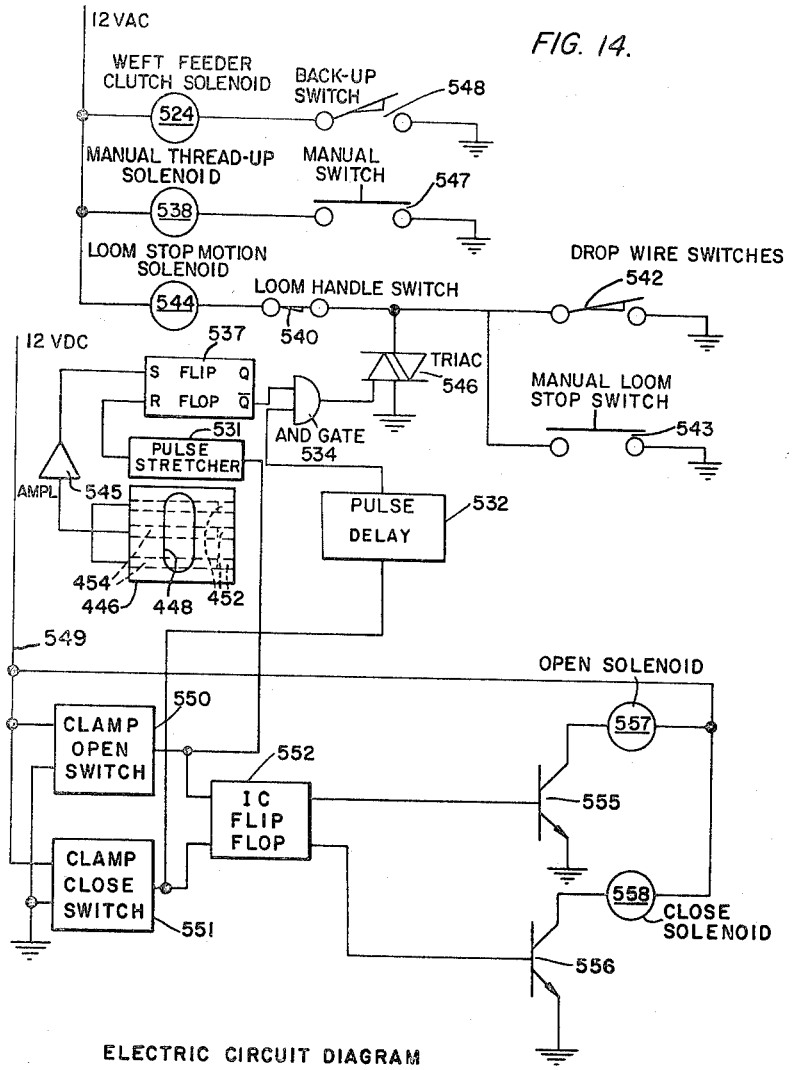
ELECTRIC CIRCUIT DIAGRAM

FIG. 24A.
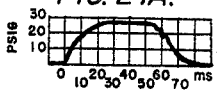
FIG. 24B.
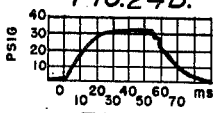
FIG. 24C.
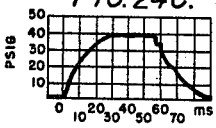
FIG. 24D
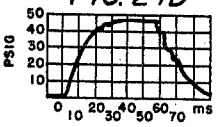
FIG. 24E.
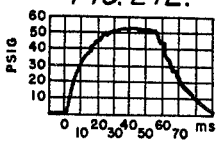
FIG. 24F.
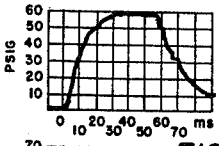
FIG. 24G.
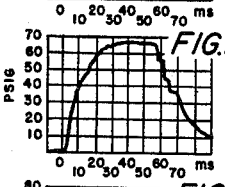
FIG. 24H.
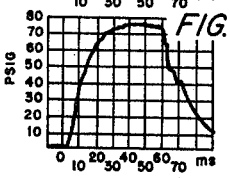
FIG. 24I.
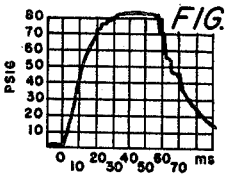
FIG. 25A.
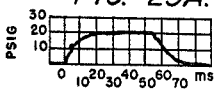
FIG. 25B.
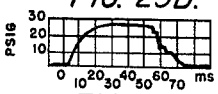
FIG. 25C.
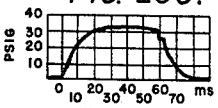
FIG. 25D.
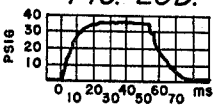
FIG. 25E.
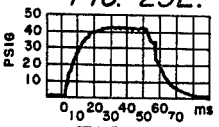
FIG. 25F.
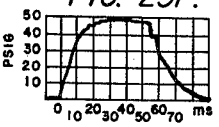
FIG. 25G.
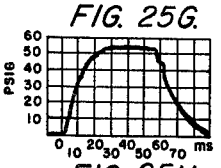
FIG. 25H.
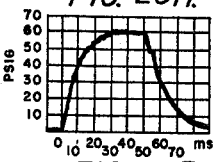
FIG. 25I.
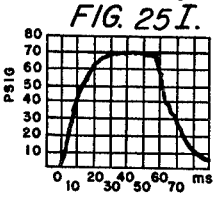
FIG. 26A.
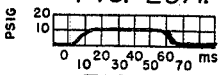
FIG. 26B.
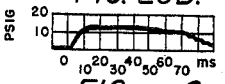
FIG. C.
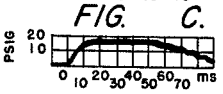
FIG. 26D.
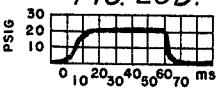
FIG. 26E.
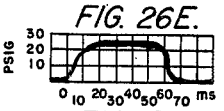
FIG. 26F.
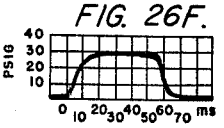
FIG. 26G.
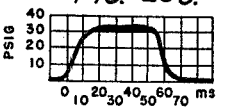
FIG. 26H.
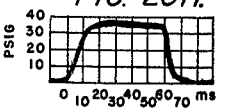
FIG. 26I.
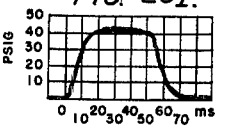

STRAND DELIVERY AND STORAGE SYSTEM

INDEX

Cross Reference to Related Applications
Field of Invention
Background and Prior Practice
Summary of the Invention
Statement of Objects
Brief Description of Drawings
General Description of System of Invention
Detailed Description of Invention
I. Apparatus
a. Interrupted Guidance Tube Withdrawal Mechanism
b. Weft Insertion Nozzle Assembly
(1) Single Embodiment
(2) Modified Embodiment (Floating "Pill")
c. Pilot Pressure Control System for Insertion Nozzle
(1) Electrical Embodiment
d. Weft Metering and Storage
(1) Preferred Rotating Drum Embodiment
(2) Alternative Fixed Drum Embodiment
e. Weft Reception and Arrival Detection
f. Air Circuit
g. Electrical Circuit Diagram
II. Operation and Comparative Tests
a. Introduction
b. Nozzle Pressure
(1) Definition of Choking
c. Nozzle Contour
(1) "Supersonically Contoured" Nozzle— Effect of Contoured Nozzle With and Without Extension Barrel on Air and Weft Arrival Times (Table I)
(2) "Straight" Nozzle—Effect of Throat Area Variations on Air and Weft Arrival Times (Table II)
d. Nozzle Supply Capacity
(1) Effect of Capacity Variation on Weft Arrival Times (Table III)
e. Air Pulse Duration
(1) Effect of Pulse on Air and Weft Arrival Times (Table IV)
f. Comparative Simulation of Prior Art
(1) Effect of Prior Art Simulation With Varying Nozzle Area of Air and Weft Arrival Times (Table V)
(2) Comparison of Pressure Traces of Prior Art and Inventive Systems
g. Other Conditions
(1) Effect of Varying Air Velocity on Air Arrival Time (Table VI)
(2) Effect of Varying Spacing Between Nozzle and Guidance Tube (Table VII)
(3) Effect of Varying Nozzle Mach No. on Air Weft Arrival Time (Table VIII)
(4) Effect of Varying Nozzle Area on Projected Energy Consumption (Table IX)
h. Balanced Mode
i. Other Conventional Factors
j. Specific Example

CROSS-REFERENCE TO RELATED APPLICATIONS

This application is directed to subject matter which is disclosed as part of an entire operative air weft injection loom system, incorporating a variety of improved features, in application Ser. No. 64,180, filed Aug. 6, 1979, under the title Air Weft Insertion System, in the names of Charles W. Brouwer et al, which application is now U.S. Pat. No. 4,347,872.

FIELD OF THE INVENTION

This invention relates to a loom weaving system in which the weft is inserted through the shed of the loom by means of a pulse-like jet of air or other pressurized gaseous medium (hereinafter referred to generally as an air weft insertion system) and is concerned more particularly with an efficiently operating and simply designed strand delivery system which is particularly effective for purposes of a loom weaving system of the air weft insertion type.

BACKGROUND OF THE INVENTION AND PRIOR PRACTICE

A general description of weaving and general descriptions of the known air weft projection techniques in the art, including a theoretical analysis of the projection of wefts by means of a moving gaseous stream, which constitute part of the "Background of the Invention and Prior Practice" of this invention appear under the same heading in application Ser. No. 64,180 above, and are incorporated by reference herein in entirety.

Irrespective of the particular category of air weft insertion system, the delivery of the strand to the system plays an important part in the practical success or failure of the system itself and heavy attention has been directed in this art to designing an developing strand handling or delivery systems which would satisfy the rather special requirements which are inherently created by air weft insertion. In general, these efforts have resulted in excessively complicated arrangements which are prone to failure over long periods of time and moreover must be operated in fairly critically controlled timed relation to the weaving cycle of the loom. It would obviously be advantageous in the art to simplify the delivery of the strand to the air weft insertion means.

An even more critical aspect of the strand delivery problem is the maintenance of effective control over the length of the strand as it is being propelled through the shed of the loom under the impetus of the air insertion means. The criticality of this problem distinguishes an air weft insertion system from a liquid, i.e. water, insertion system since in the latter the leading end of the weft length to be inserted is physically adhered to the column of water that is being projected across the shed and moves bodily therewith so that the leading end of the strand and the leading end of the water column must move across the shed as an integral unit and arrive at the opposite side of the shed at the same moment. Thus, in a water injection loom, the projection of the water column and strand is reduced simply to a "ballistics" analysis, e.g., whether the mass of the water being projected and its velocity is adequate to traverse the particular length of the shed and pull the weft length therebehind.

The operative circumstances are entirely different in an air insertion system wherein the "air column" and the leading yarn end cannot arrive simultaneously, especially with the realization that, in fact, the existence of any discrete "air column", in the sense of a coherent column of air which maintains its integrity during its travel from one point to another is almost certainly out of the question, due to the fact that the starting "air column" completely loses its identity during passage through the shed, at least when the insertion system includes the interrupted guidance tube, as is preferred for reasons explained in the incorporated material above.

Thus, the burst or pulse of air that actually arrives at the opposite side of the shed cannot be the same burst or pulse of air that was initially emitted by the insertion means and, indeed, it can be proven mathematically that the burst of air that is perceived at the reception end cannot be the same air emitted from the insertion means. The phenomena occurring within the guidance tube as the air pulse passes therethrough are too complex to permit a full understanding at this time, but it is clear that the behavior of the air pulse is radically different from the behavior of a water stream due to the inherent difference in the nature and behavior of moving streams of air and water.

In general, prior art air weft insertion systems elected to so deliver the air that the critical problem of maintaining control over the delivery of the projected strand is minimized by simply prolonging the burst of air emitted from the insertion means as needed for the strand to move the required distance, or alternatively, further nozzles are inserted within the shed to in effect prolong the air flow. Thus, the prior art insertion means is caused to emit a burst of air for whatever length of time is required to insure that the weft strand is projected entirely across the full length of the shed and the high consumption loss of compressed air accompanying this technique is accepted as an unavoidable necessity. Inherent advantages are possible by the utilization instead of a high energy short duration burst of air, as is the objective of an improved overall weft insertion system in which the present invention is preferably associated and is disclosed in such association herein, but under such circumstances, the problem of strand delivery becomes particularly critical. Such high energy pulses impart such acceleration to the strand that the leading end tends to be overrun by trailing portions as it encounters the frictional resistance of the atmospheric air that it must penetrate, resulting in the creation of undesirable tangles in the inserted weft.

SUMMARY OF THE INVENTION

In accordance with the present improvement, there is provided a strand delivery system which meters out from a weft supply source the length of strand appropriate to the length of the shed of the loom in question in positive adjustable manner and makes such length available to the insertion means, e.g. injection nozzle, so that the latter can withdraw only the length of the strand that is needed for each particular weft. The metered out length of yarn is first collected in coils in a temporary storage zone formed by a first surface, and these coils are displaced bodily axially to a second storage zone at a rate delivering to the latter precisely the length of yarn required to be made available to the insertion nozzle for projection across the shed. The strand is precluded from premature or excessive advance from the first to the second zone caused by the withdrawal of the same from the latter during insertion.

The improved delivery system of the invention additionally contemplates the achievement of control over the projection of the strand in order to correlate the arrival of its leading end at the opposite shed side with the complete removal of the length to be inserted from the second storage zone so that the strand remains in essentially straightened condition during its flight and when its leading end arrives at the opposite shed side extends in an essentially straightened condition back to the beginning of the second storage zone. To this end, the nozzle is equipped with means for either decreasing or increasing the efficiency of the transfer of propulsive force from the air propulsion medium and the strand contained within the nozzle.

The delivery system of the invention is also equipped with means for temporarily taking up and maintaining under control any slack that may develop in the strand during its withdrawal from the second collection zone.

STATEMENT OF OBJECTS

An object of the invention is an improved weft metering and storage unit capable of automatically supplying to the insertion nozzle a length of weft precisely matched to the width of the loom without complex control instrumentation.

Another object of the invention is an improved weft metering and storage unit in which the yarn is advanced from a yarn supply to a first storage stage on which it is wound in coiled form, preferably spaced apart axially of a cylindrical winding surface, and is then transferred from the first storage stage onto a second collection stage in which it is wound in coils in a length essentially equal to the length of yarn that is to be consumed during each cycle of the weaving operation as weft yarn is inserted by the weft insertion nozzle through the shed of the loom.

A still further object is the association with an improved delivery unit of the type described in the preceding object of means limiting the length of yarn being removed from the second stage to the yarn contained on that stage and precluding the accidental withdrawal of further yarn from the first stage.

A further object of the invention is a yarn delivery unit of the type just described which is provided with air compliance means for exposing the coils of yarn wrapped upon the second stage to a surrounding flow of pressurized air to maintain the same under control.

A still additional object of the invention is a unit of the type just described in which the air compliance means is capable of withdrawing any slack developing in the yarn downstream of the second stage and restoring any slack length into coiled position on the second stage.

BRIEF DESCRIPTION OF DRAWINGS

These and other objects and advantages will be more fully explained by the following complete description when read in conjunction with the accompanying drawings in which:

FIGS. 2A and 2B are enlarged detail views looking at the left end of the lay of the loom of FIG. 1 in rearward weft inserting position and forward beat up position, respectively, showing the compound motion of the weft guidance tube;

Figure 20:
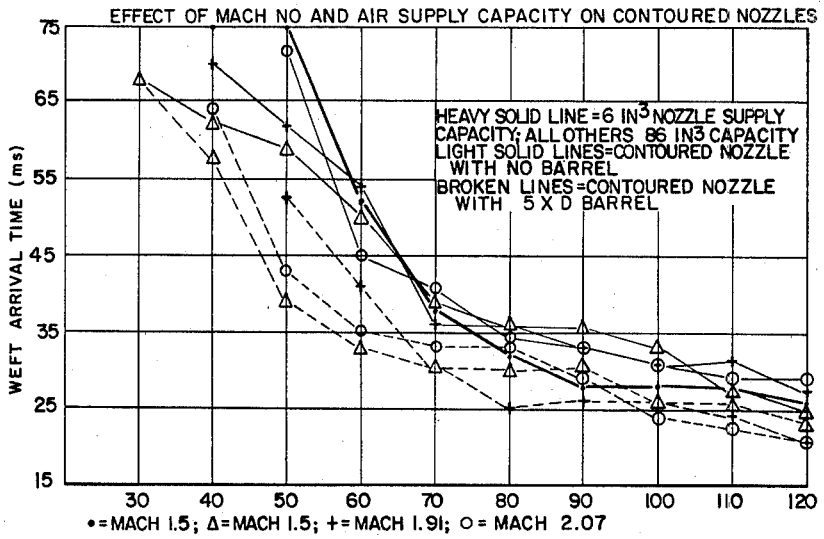
Figure 17:
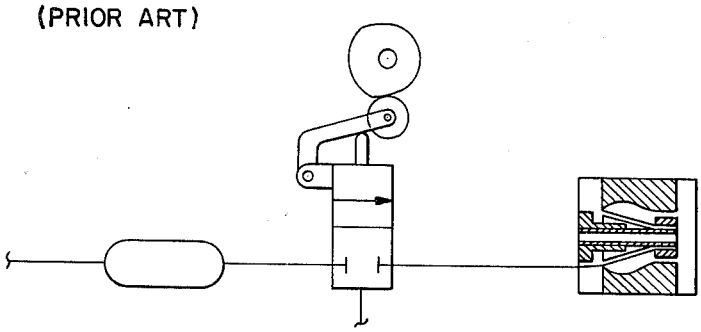
FIG. 17. (PRIOR ART)
Figures 7, 8:
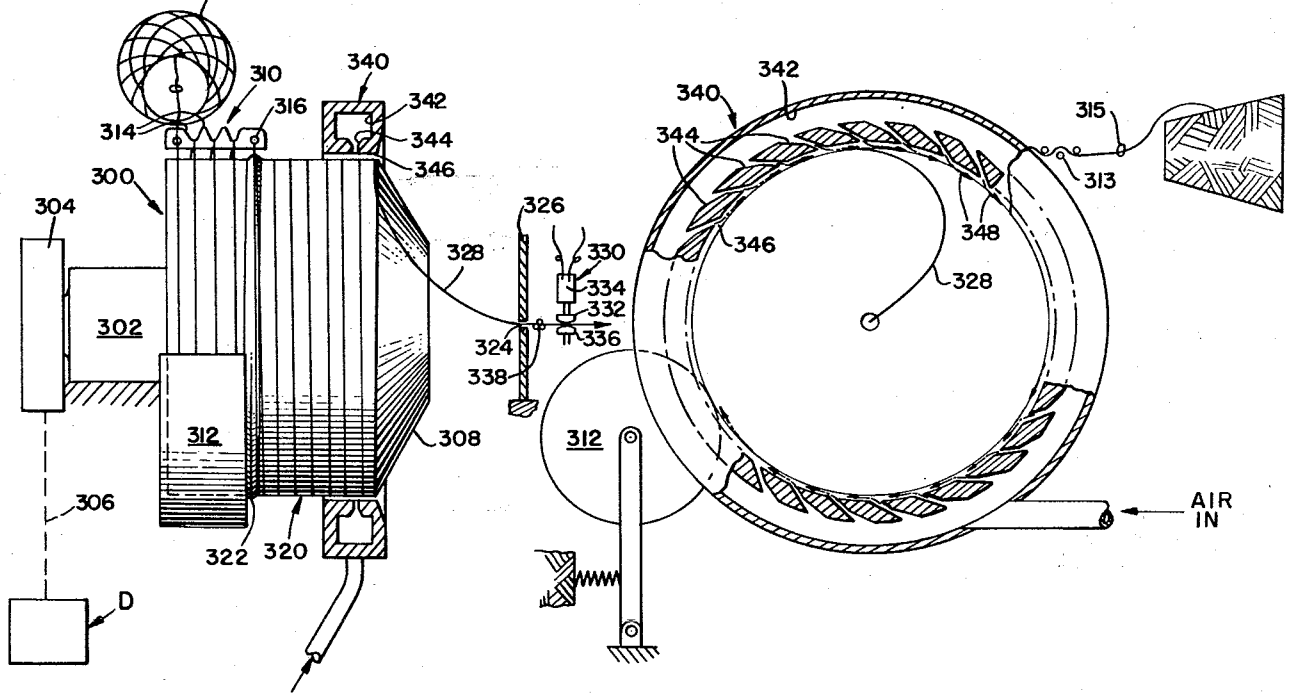
Figure 9:
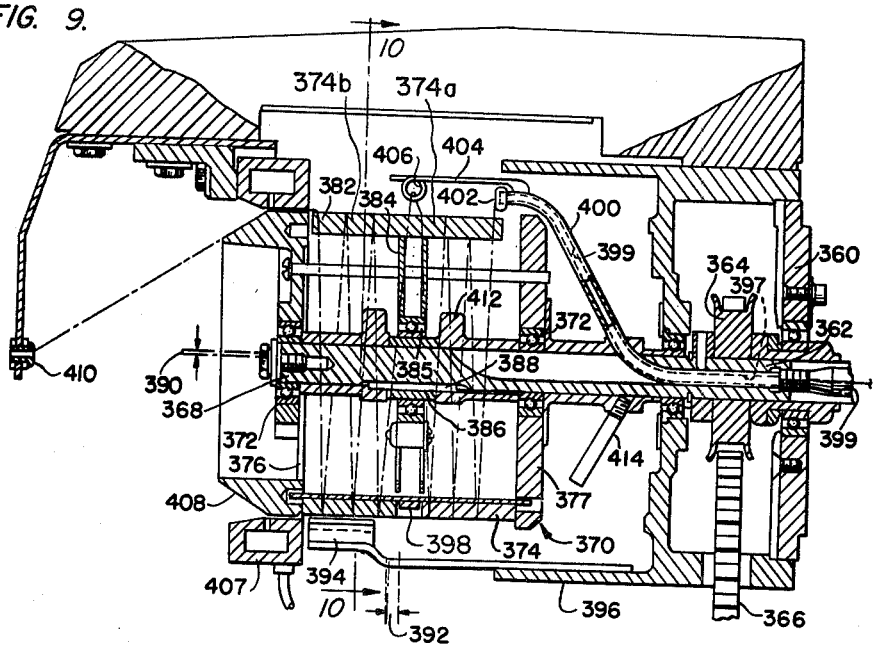
Figure 10:
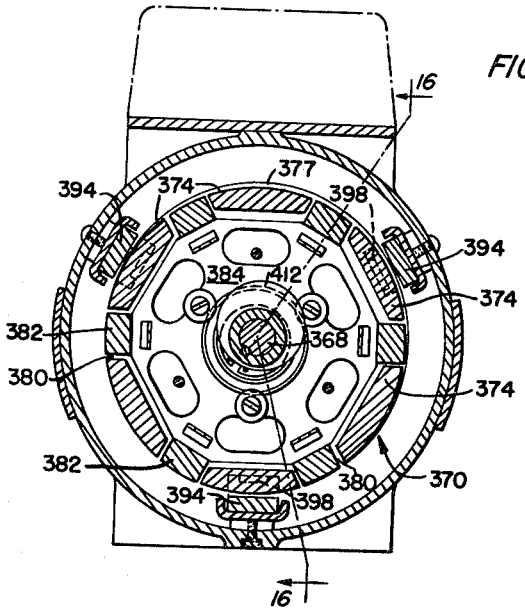
Figure 13:
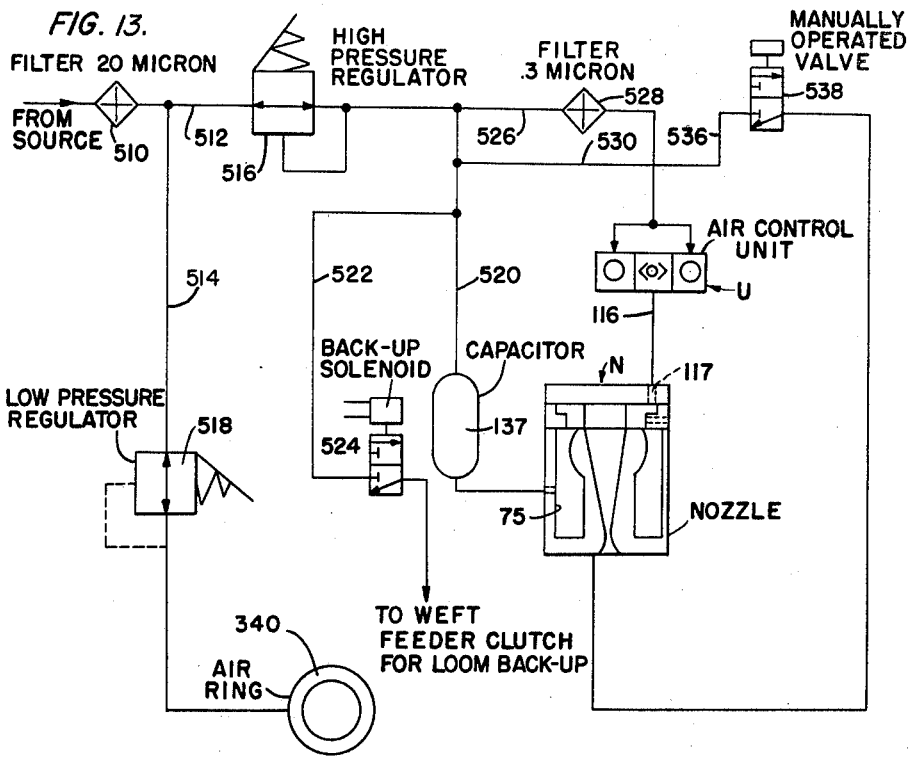
Figure 29:
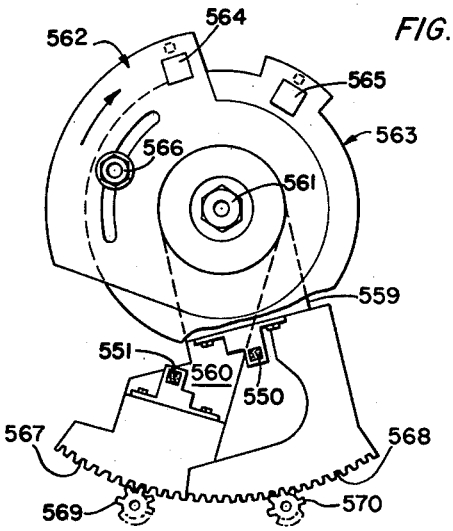
Figure 15:
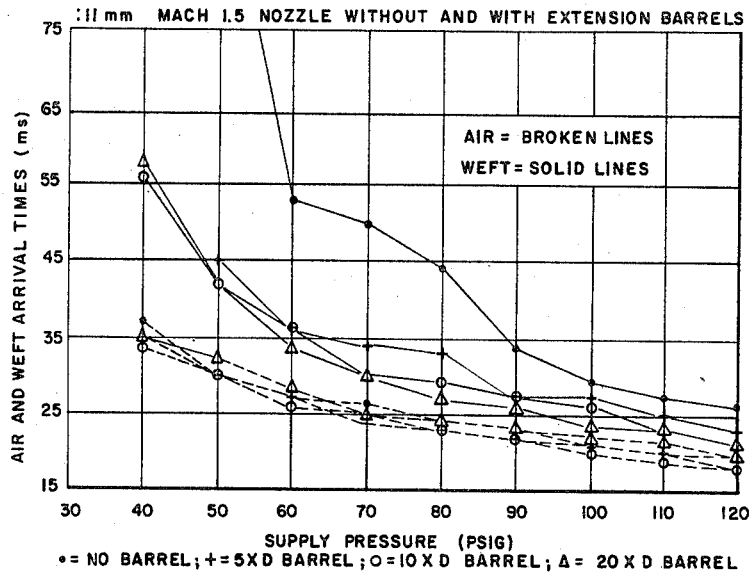
Figure 16:
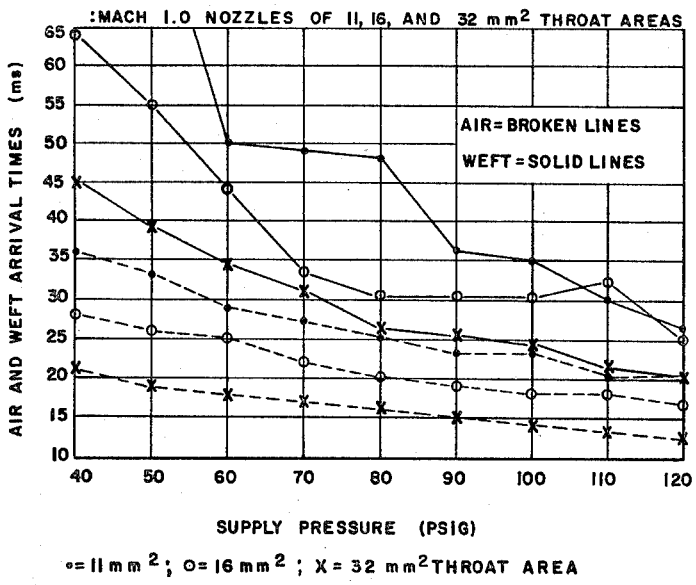
Figure 18:
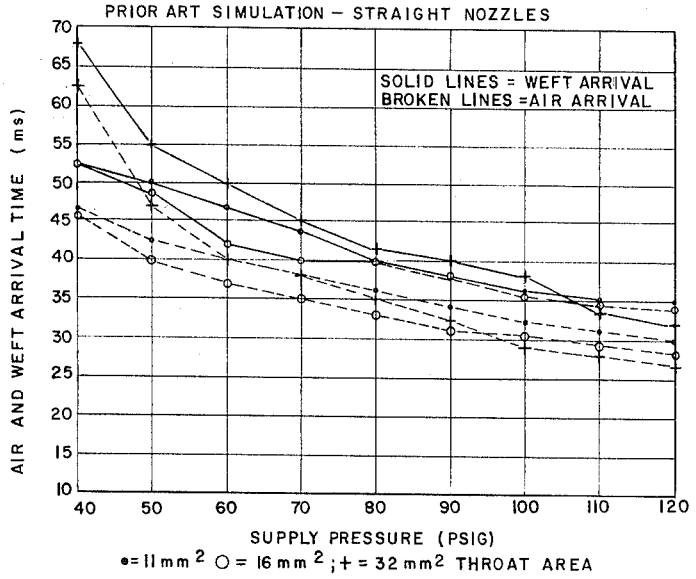
Figure 19:
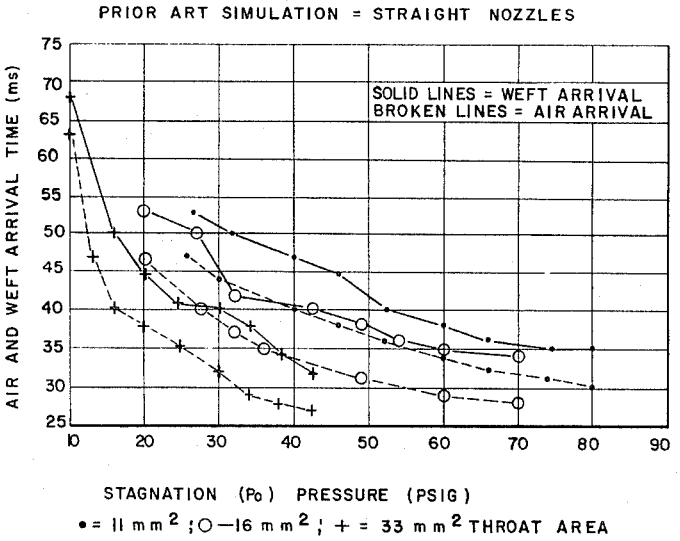
Figure 21A:
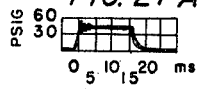
Figure 21B:
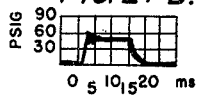
Figure 21C:
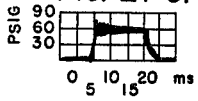
Figure 21D:
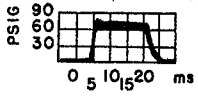
Figure 21E:
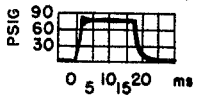
Figure 21F:
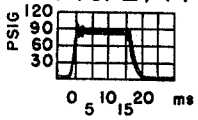
Figure 21G:
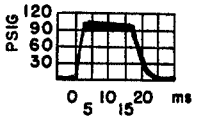
Figure 21H:
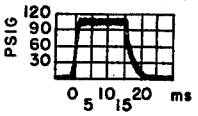
Figure 21I:
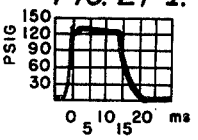
Figure 22A:
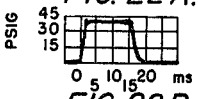
Figure 22B:
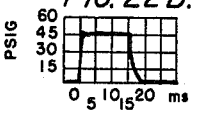
Figure 22C:
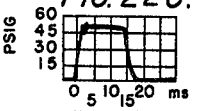
Figure 22D:
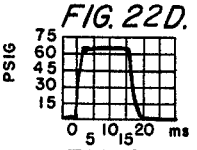
Figure 22E:
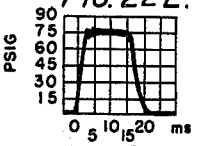
Figure 22F:
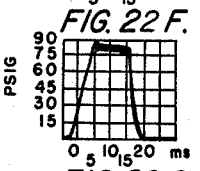
Figure 22G:
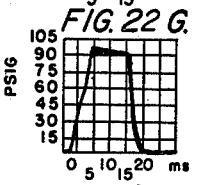
Figure 22H:
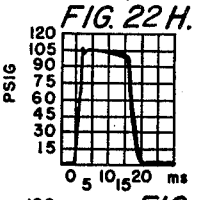
Figure 22I:
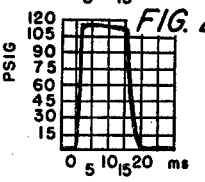
Figure 23A:
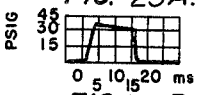
Figure 23B:
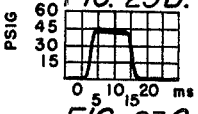
Figure 23C:
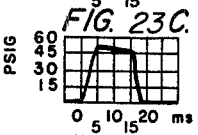
Figure 23D:
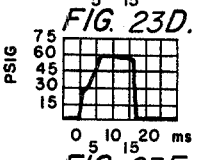
Figure 23E:
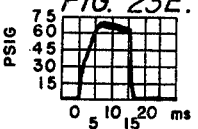
Figure 23F:
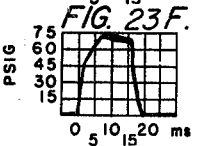
Figure 23G:
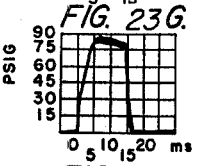
Figure 23H:
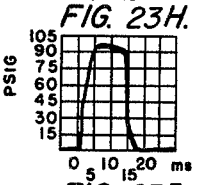
Figure 23I:
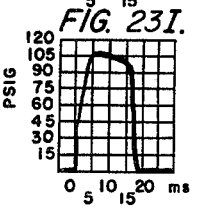
Figure 27A:
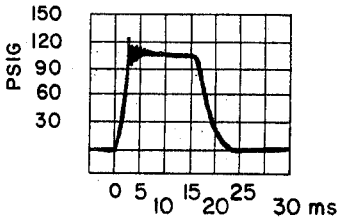
Figure 27B:
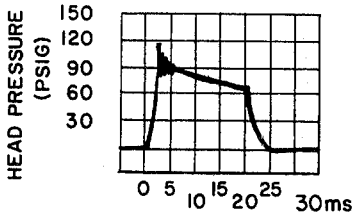
Figure 28:
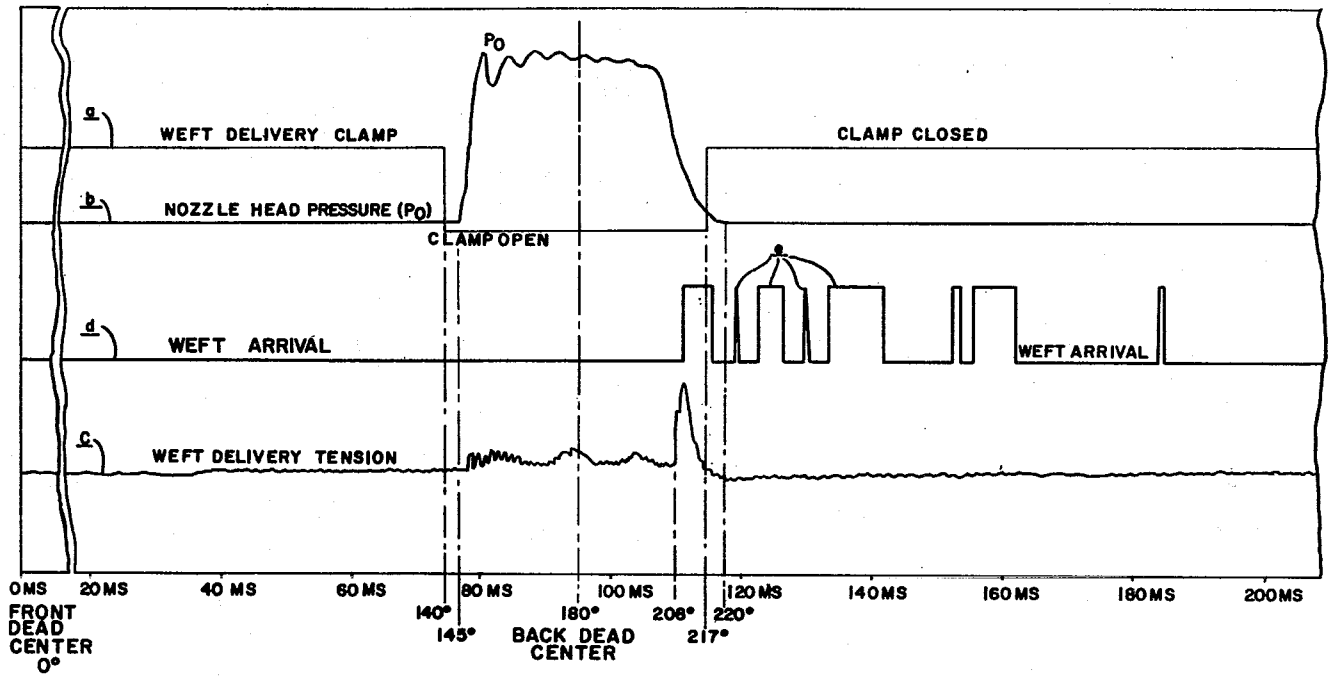

FIG, 7 is a side elevational view, partly in cross section, of one embodiment of weft metering and delivering unit utilizing a rotating drum;

FIG. 8 is an end view of the weft metering and delivering unit of FIG. 7, partly cut away to show the interior of the associated air ring;

FIG. 9 is a side elevational view partially in cross-section of a modified weft metering and delivering unit utilizing a stationary winding drum;

FIG. 10 is an end view partially in section of the modified metering and delivering unit of FIG. 9;

FIG. 11 is a detail view of one form of weft reception tube with an associated weft engaging clamp;

FIG. 12 is a detail view of a modified weft reception tube incorporating photoelectric detection devices for signalling the arrival of the weft end;

FIG. 13 is a schematic air circuit diagram for a preferred embodiment of the invention;

FIG. 14 is a schematic electrical circuit diagram for a preferred embodiment of the invention;

FIG. 15 is a graph plotting air and weft arrival times against supply pressure over a range of 40–120 psig for an 11 $mm^2$ supersonically contoured nozzle with and without extension barrels of lengths equal to b 5, 10 and 20 times the diameter of the nozzle outlet;

FIG. 16 is a graph similar to FIG. 15 for three uncontoured nozzles having throat areas of 11, 16 and 32 $mm^2$, respectively, without extension barrels;

FIG. 17 is a schematic view indicating diagrammatically an arrangement for simulating a prior art air weft insertion system;

FIG. 18 is a comparative graph similar to FIG. 16 but representing the performance of a simulation of a prior art air weft insertion system using uncontoured nozzles of varying throat areas;

FIG. 19 is a comparative graph plotting air and weft arrival times versus actual nozzle stagnation or head pressure achieved by the prior art simulation of FIG. 17 with the same nozzles as in the graph of FIG. 18;

FIG. 20 is a plot similar to FIGS. 15 and 16 of the system of the invention comparing the weft arrival times over a range of supply pressures of 30–120 psig for supersonically contoured nozzles ranging from Mach 1.5 to Mach 2.07, with and without an extension barrel equal in length to five times the nozzle outlet diameter, supplied with air from a large capacity accumulator, with the Mach 1.5 nozzle being also operated with a low capacity accumulator for comparative purposes;

FIGS. 21A–I represent reproductions of actual oscillographically derived pressure traces showing the changes in head pressure versus time in air pulses generated by the 11 $mm^2$ throat area uncontoured nozzle of FIG. 16 when operated at 10 psi intervals over the range of supply pressures of 40–120 psig;

FIGS. 22A–I are reproductions of pressure traces similar to FIGS. 21A–I but for a 16 $mm^2$ throat area uncontoured nozzle and on a different scale;

FIGS. 23A–I are recreations of pressure traces similar to FIGS. 21A–I and 22A–I but for the 32 $mm^2$ throat area uncontoured nozzle and on the same scale as FIG. 22A;

FIGS. 24A–I are comprative recreations of pressure traces similar to FIGS. 21A–I but on a different scale for the prior art simulation of FIGS. 27 and 18 utilizing an 11 $mm^2$ throat area uncontoured nozzle;

FIGS. 25A–I are comparative recreations of pressure traces similar to FIGS. 22A–I but on a different scale for the prior simulation with a 16 $mm^2$ throat area uncontoured nozzle;

FIGS. 26A–I are comparative recreations of pressure traces similar to FIGS. 23A–I but on a different scale for the prior art simulation with a 32 $mm^2$ throat area uncontoured nozzle;

FIG. 27A is a recreation in terms of head pressure versus time on a still different scale of a pressure trace generated by the preferred nozzle in the system of the invention equipped with an added supply capacity or accumulator; while FIG. 27B is a recreation of a pressure trace for the identical system absent any added supply capacity or accumulator and illustrating the change in time in peak pulse pressure at the lower supply capacity compared with the pulse of FIG. 27A;

FIG. 28 is a reproduction of an actual "strip chart" produced by a multi-channel oscilloscope monitoring one operative cycle of a loom according to the invention following the preferred balanced mode of operation, and showing wave forms corresponding to nozzle throat pressure, delivery clamping actuation, weft delivery tension, and weft arrival at the reception tube and ;

FIG. 29 is a detail view of a mechanical arrangement for actuating the clamp open and close switches permitting precise adjustment of the actuation times thereof.

GENERAL DESCRIPTION OF SYSTEM OF INVENTION

Figures 1, 3:
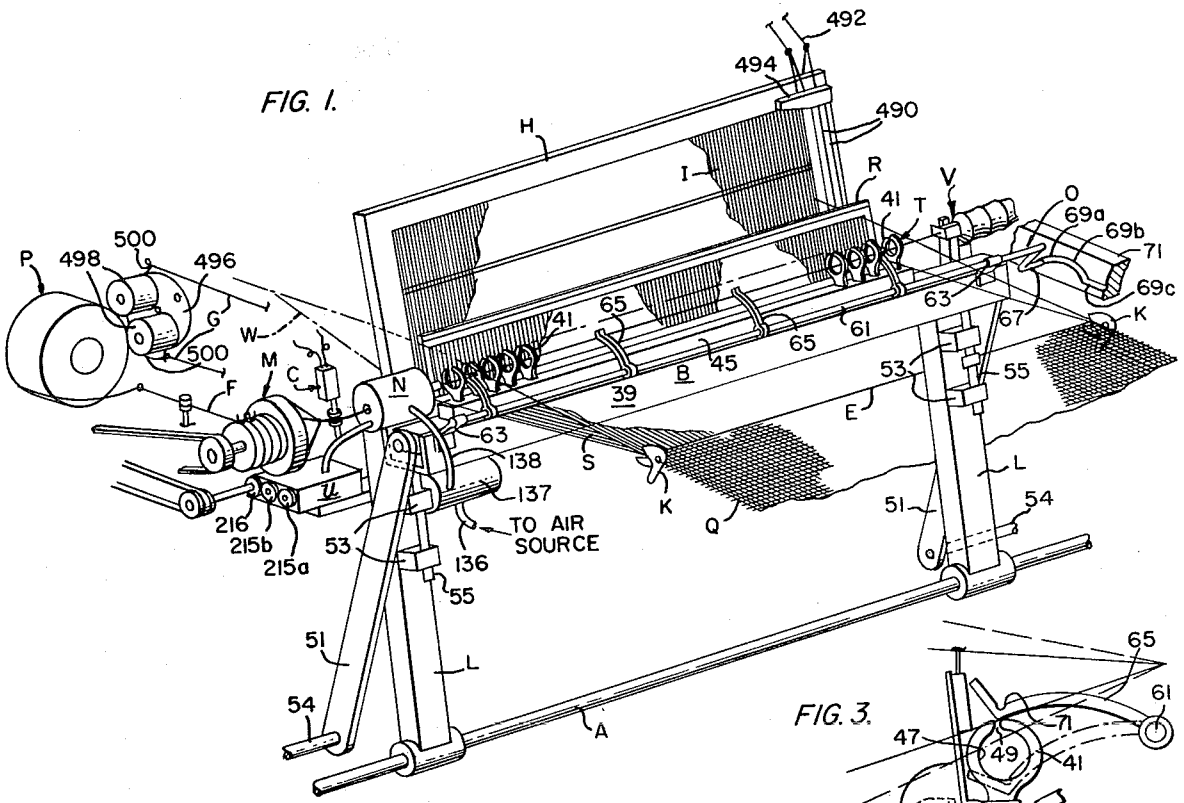
FIG. 1 is a highly schematic view in perspective of the essential components of a weft insertion loom incorporating the present invention.
FIG. 3 is an enlarged detailed view of the upper portion of the lay in beat up position as in FIG. 2B showing the weft lift-out device in projected position in solid lines and in retracted position for weft insertion in dotted lines.

The loom of the present invention is basically conventional in much of its construction and operation (with one adaptation to better suit the requriements here), and the loom structure is illustrated schematically in an overall view in FIG. 1 and described generally with alphabetical designation only in enough detail to establish the context of the present improvements. As usual, the warp threads on ends W are carried on a rotatably supported warp beam (not seen) and pass therefrom through the eyes of parallel arrays of heddle wires I arranged in two or more separate groups held in adjacent parallel planes by corresponding heddle frames H. The heddle frames H are mounted for alternating up and down reciprocation whereby the groups of warp threads are separated to form an elongated diamond-shaped shed S having its front corner defined by the fell E of the fabric being woven. Forwardly of the heddle frames H, a lay beam B extends withwise across and beneath the lower plane of the warp, the lay beam B being mounted at its ends on generally upstanding supports or swords L which are pivoted on a shaft A at their lower ends and are rocked to and fro by driving means, such as a crankshaft, not shown. A reed R in the form of a sheet-like array of wires on the flat plates with the warp threads passing in the clearance space therebetween projects upwardly from the rear side of the lay to impress each new weft against the fell as the lay rocks forwardly. The woven fabric is collected in a conventional way upon a take-up beam, not shown.

The fabric has a rough or fringe selvage Q because the weft is inserted in the warp shed continuously from the same side of the warp shed rather than alternately from opposite sides as in conventional shuttle weaving. This rough selvage may be trimmed by means of trimming shears or knives K in operative position at the fell line an actuated in the usual way.

In accordance with the invention, the lay B of the loom is equipped with an interrupted segmental weft guidance tube to facilitate in a manner known in itself the delivery of weft or filling strands F through the shed, the guidance tube obtruding in interdigitating fashion with the warp ends into the interior of the shed when the lay is in its rearmost position and withdrawing from the shed while the lay moves forward. The lay preferably carries a weft lift-out device generally designated O to positively displace the inserted weft F from the guidance tube. The weft is projected into the interrupted guidance tube by means of a burst or pulse of air emitted by a weft insertion nozzle N mounted on the lay adjacent one side of the shed, while the free end of the inserted weft is received beyond the far side of the shed within a vacuum reception tube V carried on the opposite end of the lay and if desired is engaged by a clamp (not seen in FIG. 1) associated with that tube. Preferably, the tube is displaceably supported to follow the path of the weft during beat up. The reception tube can include photoelectric detection means (not seen) to detect the arrival of the weft thereat and initiate a control signal in the absence of the weft. The generation of the pulse or burst of air through the nozzle is precisely controlled by means of a nozzle activation control unit U which is actuated in timed relation to the cyclical operation of the loom. A proper length of weft is withdrawn from a weft package or other source P and made available to the insertion nozzle N by means of a strand metering and delivering unit M disposed at a fixed position outboard of the insertion nozzle N, and a clamping means C is interposed between the metering unit M and nozzle N for positively gripping the weft F in timed relation to the inserting action.

DETAILED DESCRIPTION OF INVENTION

The improved strand delivery system of the present invention is preferably employed in the context of an overall improved weft insertion system embodying a number of other advantageous features which are described individually in the following detailed explanation together with the details of the strand delivery system itself.

I. Apparatus a. Interrupted Guidance Tube Withdrawal Mechanism

In a conventional loom, the lay consists of a large massive beam extending entirely across the width of the loom, the upper surface of the beam lying when in rearward weft insertion position virtually coplanar with the threads forming the lower side or floor of the shed whereby the shuttle can slide on the beam when moving through the shed.

In the loom of the present invention, the lay beam's massiveness is expendable, and only enough of a skeleton beam is retained, e.g. in the form of an upwardly opening channel 39 fixed to the ends of lay swords L, as required for the mechanical support of various components including the segmented or interrupted weft guidance tube T of the invention. As mentioned, this tube T consists of an axially aligned array of thin annular segments 41 (better seen in FIGS. 2A and 2B) which preferably have an axial thickness not greater than about $\frac{1}{8}''$ to allow their introduction upwardly into the interior of the shed S through the clearance spaces between warp threads W without abrading or otherwise damaging the warp and an annular thickness appropriate for mechanical strength, say $\frac{1}{4}$–$\frac{3}{8}''$. Each tube segment 41 has a radial foot-like extension 43 projecting from a lower peripheral point to enable the elements to be mounted in spaced axially aligned relation upon a transversely extending common base 45 in which the extension ends 43 are fastened or embedded. Each weft thread F duirng insertion is projected through the interior bore 47 of predetermined diameter of the axial array of the annular segments 41 and provision is made for the escape of the weft thread laterally from the segment array as it is withdrawn from the shed, by way of a narrow gap 49 formed in each segment at a common peripheral point on the rear upper quadrant thereof.

In prior art constructions, the interrupted guidance tube is fixed relative to the lay. Obviously, the guidance tube elements must, in any case, be completely withdrawn from the interior of the shed S before the reed R reaches beat up position to permit the weft F to float free within the shed before being pressed against the fell E of the fabric by the forward motion of the reed R. In general, prior art arrangements have usually required some change in the normal arcuate path of the lay so as to achieve a timely withdrawal of the guidance tube, for example, by tilting the lay and reed bodily forwardly toward the fell of the fabric. This results, however, in the reed having a considerable inclination at its beat up position which means that the force riving the thread against the fabric fell E is applied at an angle to the plane of the fell, displacing the thread downwardly at the same time as it is pressed forwardly againgst the fell, which can lead to distortions in the fabric, whereas in conventional loom design, the arcuate path of the upper lay end is more or less symmetrical about a vertical plane so as to give the best compromise between the preferably horizontal position of the lay during weft insertion and the preferably vertical position of the reed at beat up position.

In the present invention, the lay construction is modified to incorporate a mounting permitting relative vertical displacement of the weft insertion tube. The design of the mounting is not critical and can take various forms. For example, each lay sword can be provided with a vertically spaced pair of collars 53 in axial alignment for sliding reception of a slide rod 55 passing through openings in the bottom of channel 39 (FIG. 1) and attached at its upper end to the supporting base 45 of insertion tube T. The ends of the base 45 are connected to the upper ends of generally upstanding driving links 51 which are pivoted at their lower ends to the frame of the loom on a pivot axis 54 displaced rearwardly from the pivot axis A of the lay swords L. Consequently, when the lay pivots, the upper ends of drive links 51 swing through a more inclined arc indicated by dashed arrows than the upper ends of the lay swords L creating a vertical displacement of the guidance tube base 45, and thus of the guidance tube T itself, relative to the lay channel 39. In this way, during beat up the guidance tube T has a compound motion, swinging arcuately with the lay while moving vertically by itself, and the point of its full withdrawal from the shed can, therefore, be varied as desired independently of the position of the lay B by adjusting the position of the lower pivot axis 54 of the drive links 51 relative to the pivot axis A of the lay swords L.

Early withdrawal of guidance tube T during beat up is advantageous in giving greater opportunity for the warp threads to recover from any distortion in their normal position as a consequence of the removal of the guidance tube segments 41 from therebetween. It has been found that if the tube is fixed relative to the lay and its withdrawal is thus delayed, the warp threads (which must shift laterally somewhat to allow passage of the guidance tube segments) may be held in such displaced position at the time the weft is pressed against the fabric fell and become "locked" in this aberrant position when the shed collapses during reversal of the warp thread groups of the shed. This results in observable defects in the uniform spacing of the warp threads within the resultant fabric, producing what is knwon as a "reedy" fabric, because such defects are normally characteristic of excessively thick reed elements.

In selecting the position of the exit slot or gap 49 (FIGS. 2A and 2B) in the guidance tube segments 41 along the upper peripheral portion thereof, consideration should preferably be given to the compound motion of guidance tube T, including both the vertical component as well as the usual arcuate component. Thus, the less the vertical displacement of the guidance tube, the closer the position of exit slot 49 to the lower end of the upper segment quadrant adjacent reed R and vice versa.

The guidance tube segments 41 themselves can be molded of any strong durable plastic material, such as that sold under the name Delrin, preferably filled or reinforced with chopped glass fibers for increased strength. Segments consturcted in this manner have the slight disadvantage of nonconductivity and can be susceptible to the build up of static electrical charges during weaving. This can be avoided by applying a metallic coating, for example, by vacuum deposition, to the segments and grounding them electrically to the frame of the loom. Alternatively, the segments can be formed of cast metal. In assembling the guidance tubes of the invention, a plurality of such segments of sufficient number (dependent upon the width of the loom and the desired separation) are arranged in axially aligned position on a jig, giving what has been found to provide a reasonably accurate alignment with a deviation of ±1-2/1000". Deviations of this magnitude can be tolerated without substantial deleterious effect; however, significantly better performance can be achieved when the interior walls of the arrayed segments 41 are subjected to a honing operation. For this purpose, an elongated rod having a slightly tapered axially slotted cutting head with a maximum diameter slightly exceeding the starting undersize bore diameter of the segments as molded is passed through the segment array while being rotated at a moderte speed of a few hundred rpm, by means for instance of a hand drill, the head of the rod being coated with any commercial honing compound consisting of a fine abrasion suspended in a lubricating carrier. Honing produces highly uniform alignment of the bore apertures of the segments in the guidance tube array and removes any interior irregularities. Sufficiency of the honing operation can be checked visually by sighting with the eye along the bore of the array and noting when the bore surfaces appear bright or shiny.

By way of illustration of an effective tube assembly for weaving with warp threads of 40's cotton at a density of about 72 threads per inch of loom width, one might use one tube segment per 20 warp threads.

The size of the bore diameter of guidance tube T can significantly affect the operation of the system if selected inappropriately. For instance, with nozzles of various contours and throat corss-sectional areas ranging between 8 and 32 $mm^2$, a bore diameter of $\frac{3}{4}$" works well. If the diameter is reduced to $\frac{5}{8}$", only the largest (32 $mm^2$) nozzle can project the weft the full width of a normal loom, and the weft travel time is prohibitively increased. Apparently, the bore diameter needs to be relatively large for relative easy entry and passage of the air jet delivered by the nozzle. First, the diameter of the tube bore 47 in relation to the outlet diameter of the nozzle, its spacing from the tube entrance, and the cone angle of the jet must be sufficient that the jet substantially fully enters the tube entrance. Second, the bore 47 should not be too "tight" in relation to the air column moving therethrough, as otherwise the column encounters excessive resistance in proceeding through the bore and "leaks" from the slot 49 and spacing between the tube elements. If the nozzle opening is sufficiently large to emit a massive blast of air, the impedance of a "tight" tube can be overcome, but the resistance is still manifested in seriously retarding the advance of even such a massive blast. It is not presently known how far the bore diameter might be increased without approximating an unconfined environment for the weft and losing the advantage of the guidance tube; some experimentation may hence be indicated to establish the effective limits of bore diameter variation in questionable cases.

In the embodiment of the loom of the invention illustrated in the drawings, the weft insertion nozzle N is mounted on the lay skeleton 39 in a fixed or stationary position and does not move in synchronism with the compound motion of the weft guidance tube. This permits a simplified construction and the effectiveness of the tube for weft insertion is not thereby significantly reduced. During the actual weft insertion phase, the vertical movement of the tube is vertually nil, and the axis of the insertion nozzle is aligned, well enough within the axis of the guidance tube over this phase. If desired, however, insertion nozzle N could likewise be mounted on the movable supporting base 45 for the weft guidance tube so that the axis of the nozzle would actually "track" the center line of the guidance tube over the complete operating cycle of the loom. Conceivably, this arrangement might afford some slight additional increase in overall operating speed in permitting the weft insertion phase to be initiated at a slightly earlier point in the cycle.

b. Weft Insertion Nozzle Assembly

Figure 4:
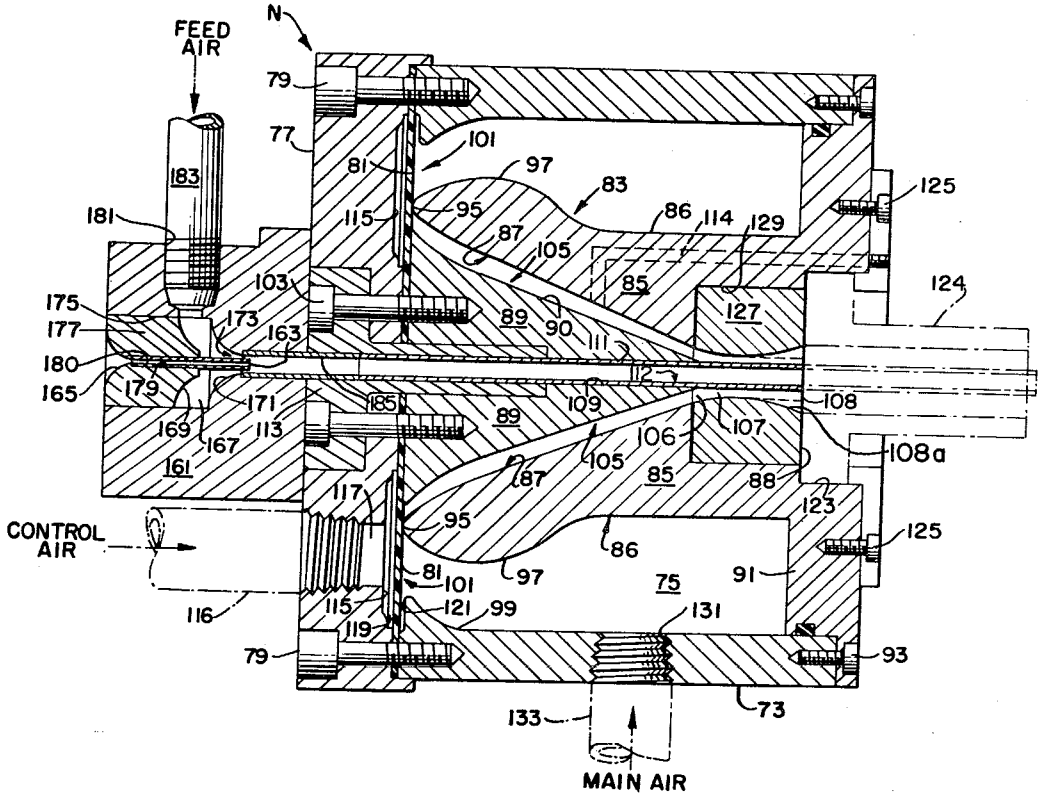
FIG. 4 is an enlarged detailed view of one embodiment of weft insertion nozzle according to the invention taken in cross-section through the nozzle axis.

In order to achieve more precise and instantaneous control over the flow of air from nozzle N for propelling the weft strand across the warp shed of the loom, a special nozzle and servo control assembly has been devised. As shown in FIG. 4, this nozzle assembly has an exterior casing 73 enclosing an interior space, the casing being preferably circular in shape, although its configuration is not critical. One end of the casing, at the left in FIG. 4, is sealed by a cover plate 77 secured via bolts or other securing means 79, a flexible diaphragm 81 being tightly clamped around its margins between the abutting surfaces of the casing and the plate and spanning the casing end. Within the interior of the casing is a two-part core generally designated 83 having the dual function of delineating with the interior wall of the casing an axially elongated annular storage chamber 75 for containing a determined amount of compressed air and forming between its two parts an annular divergent passageway ending in a throat and exit opening.

The two parts of the core including an outer hollow sleeve 85 having a generally cylindrical outer wall 86 and a conical inner bore 87 and an internal generally flaring trumpet-shaped plug 89 fitting in spaced relation within the conical bore of the sleeve. The hollow sleeve 85 can by means of an integral peripheral flange 91 at its outer (right) end 88 be affixed with screws or the like 93 to the other end of the casing, to complete the enclosure of the storage chamber space, although the sleeve and flange could be formed separately and connected together. In any event, sleeve 85 is supported in cantilever-like fashion within casing 73 by a connection of its outer end to the right end of the casing which also seals that casing and (except for the nozzle orifice), the inner end of the sleeve projecting free within the casing to adjacent its head end.

The free end edge of the hollow sleeve 85 is rounded as at 95 so as to give a smooth nearly re-entrant curvature between the adjacent margins of the conical wall 87 and the outer wall 86 of sleeve 85. Preferably, the section of outer wall 86 adjacent free end edge 95 is developed with a convex or somewhat bulbous curvature as at 97 to merge more smoothly with the rounded free end edge 95, while the corresponding section of the interior wall of casing 73 projects radially inwardly along a concave curvature as at 99 to form therebetween a gradually tapering inwardly curving annular mouth 101 at the end of storage chamber 75.

The rounded free end edge 95 of sleeve 85 makes abutting contact with an inner annular region of the diaphragm 81 and functions as the seat of a "valve" which acts, as will be explained, to control the flow of pressurized air from storage chamber 75. The interior wall 87 of the core sleeve, after a slight initial convex curvature at its end merging with the rounded free end edge 95, has a generally uniform conical inclination and within this conical space the trumpet-shaped plug 89 is held in fixed depending relation from the inner side of casing head 77 by means of fastening bolts 103 or the like, the center region of the diaphragm being pinched between the flat end face of the plug and the casing head. The outer wall 90 of the plug is spaced from the conical inner wall 87 of sleeve 85 and together define a converging annular supply passageway 105 which gradually decreases in radius toward the supported sleeve end 91 and undergoes a slight narrowing in annular thickness adjacent the rounded end edge 95 of the sleeve.

The apex end of trumpet-shaped plug 89 terminates somewhat short of the outer end of conical bore 87 of sleeve 85 and the remainder of bore 87 converges as at 106 to a throat region 107 of the nozzle connecting with the tapering annular passageway 105. Throat region 107 extends to an orifice opening 108 in the supported end of sleeve 85 either in straight cylindrical fashion as shown in dotted lines at 108 in FIG. 4, or in flaring divergent fashion as at 108*a*, as indicated in solid lines, depending upon the type of nozzle orifice opening that is desired, as will be explained.

Passing through the interior of trumpet-shaped plug 89, and preferably in coaxial relation thereto, is a small axial passage 109 which is occupied by a weft feed tube 111 extending the entire length of plug 89 and projecting therebeyond at least to the plane of the outer end face 88 of sleeve 85 and thus the outer limit of the bore 107 therein. Preferably, the strand feed tube 111 is constructed integrally with a T-shaped carrier spindle 113 embedded in the plug and fastened thereto, for instance with the same bolts 103 securing plug 89 itself to casing head 77. The feed tube and carrier spindle make a sliding telescoping fit with the axial passage 109 in the plug to facilitate ready removal of the tube for cleaning or replacement.

The interior face of casing head 77 facing diaphragm 81 opposite chamber 75 is relieved to define a shallow annular recess or manifold 115 opening toward and, in effect, closed by the diaphragm and this annular recess is connected by a line 116, shown in dotted lines in FIG. 4, through a suitable port 117 in the casing head to a source of a gaseous control medium, e.g., air (not shown) for the purpose of controlling the movement of the diaphragm. It will be understood that diaphragm 81 is exposed on its interior face to an annular area of predetermined dimension formed by the shallow manifold 115 in the casing head. Because the diaphragm will flex as required to balance the forces acting on its two faces, its movement will be determined by the ratio of each of these areas multiplied by the corresponding pressure of the media acting thereon. The annular areas of mouth 101 and manifold 115 can be the same; in that event, so long as the pressure of the control air in manifold 115 is less than the effective pressure of the air in storage chamber 75, the diaphragm 81 will be displaced upwardly away from the rounded end edge 95 of the core sleeve, establishing communication between mouth 101 of chamber 75 and the beginning end of the annular passageway 105 to the nozzle orifice opening 108.

Since annular passageway 105 begins on the radially inward side of the rounded end edge 95 of sleeve 85 proximate the chamber mouth 101, it will be seen that the instant diaphragm 81 starts to leave its seat on the rounded end edge and pressurized air begins to escape from the storage chamber mouth 101, the effective annular surface area of the diaphragm exposed to chamber pressure increases or "grows", which acts to further unbalance the forces acting to flex the diaphragm away from its seat in a kind of avalanching effect. Consequently, the diaphragm moves virtually instantaneously from its seated closed position to the limits of its unseated or open position, as allowed by its operating characteristics, i.e. its flexibility, tension clearance, etc. Thus, the opening action of the diaphragm "valve" of the nozzle of the invention is extremely rapid and, indeed, it has been found possible to achieve an operating response for the design in the order of one ms, in terms of the time required for the pressure in the annular passageway 105 to reach essentially the full pressure existing initially in storage chamber 75.

When it is desired to terminate the flow of air from storage chamber 75, a control air pressure of sufficient magnitude is reimposed on the exterior side of the diaphragm within the annular control manifold 115 and, it will be realized that if the effective inner and outer annular diaphragm surface areas are the same, a control pressure in excess of the storage chamber pressure will be required to restore the diaphragm to its seated position in contact with the rounded end edge 95 of the core sleeve. For this reason, the ratio of the annular or radial dimension of the control manifold 115 to the annular or radial dimension of the mouth 101 of the storage chamber is preferably substantially greater than 1, e.g. in the order of 2 or more to 1, to reduce the difference between closing and opening control pressure. The selection of such higher ratios of effective surface areas has the further advantage of allowing a control pressure to be derived from the same source as the supply to the storage chamber 75, recalling that the control pressure itself need not be greater than storage chamber pressure, due to the "multiplier effect" of the unequal ratio of the effective annular areas on opposite sides of the diaphragm.

Since the air in escaping from storage chamber 75 must undergo a substantial complete reversal of direction in moving from chamber mouth 101 into annular passageway 105 when the diaphragm valve opens, it is desirable for mouth 101 and the entrance to the passageway 105 to be contoured as already described to promote smooth transition in air flow and clean communication between mouth 101 and passageway 105 without sharp edges or angles in the walls and thereby reduce turbulence and friction losses in air flow and minimize abrasive wear upon the diaphragm, which must in operation undergo rapid oscillation between its closed and open positions. For the same reasons, the surface of the casing wall and head contiguous to the unsupported annular region of the diaphragm should be relieved slightly as at 119 and 121 so as to provide clearance space for the free oscillation of the diaphragm. Otherwise, the life of the diaphragm will be severely reduced. A suitable diaphragm material is buna or neoprene rubber preferably reinforced with fabric.

The total volume of passage 105 and throat 107 is made as small as possible consistent with other needs since the space downstream of diaphragm 81 contains residual air after the diaphragm closes and if too large prolongs the decay characteristics of the nozzle.

Under some circumstances, an extension of the nozzle orifice opening 108 in the outer face 88 of sleeve 85 by means of a straight cylindrically-shaped barrel 121 (seen in dotted lines in FIG. 4) may be useful. A central region of sleeve end face 88 can be recessed as at 123 for reception of one end of such a barrel 124 which can be secured in place by means of bolts or other fasteners 125 and construction of the core sleeve and supporting flange in two pieces may simplify the design of this assembly.

For versatility in use, it is advantageous for the size and contour of the throat area of a given nozzle assembly to be variable and for this purpose the throat region of the nozzle sleeve is constituted by an interchangeable insert 127 fitting with close tolerances into a socket 129 in the sleeve end. Each insert can be bored to a given size and contour to allow the nozzle characteristics to be easily changed. No special sealing or gasketing is needed at tolerances of $\pm 1/1000''$.

The weft insertion nozzle assembly N is mounted upon the lay of the loom so that the nozzle can be "fired" at the proper point in the operating cycle of the lay. As mentioned, the weft insertion nozzle could be mounted for a compound movement similar to that of the guidance tube. However, this "tracking" relationship is not required, and very satisfactory results have been achieved by mounting the nozzle in fixed relation upon the lay with its axis approximately in alignment with the axis of the interrupted guidance tube when the latter is in dwell position at the extreme rearward point of the lay motion.

Utilization of the diaphragm control "valve" just described, eliminates the need for additional control valves in the supply of the pressurized air to the storage chamber and the casing wall can have a supply port 131 connected to an end of a supply conduit 133 (in dotted lines) running to the main supply source not shown. A preferred embodiment of a complete circuit of the pressurized medium will be described later.

Because of the desirability for the nozzle to be mounted bodily upon the lay, the overall size of the nozzle is preferably kept within fairly modest proportions to avoid interference with other parts of the loom, and this in turn imposes a limitation upon the permissible capacity of the storage chamber 75 within the nozzle. In the design shown, an acceptable capacity for the storage space has been found to be 6 $in^3$. With this limited capacity, the pressure that develops within passageway 105 upon opening of the diaphragm valve may undergo early decay from a maximum or peak value equal to the storage pressure within storage chamber 75, and this decay in driving pressure can result in a reduction in the effective thrusting force actually exerted upon the weft strand. In the present preferred practice of the invention, the driving pressure is sustained during the duration of the air pulse emitted from the nozzle orifice as closely as possible to its maximum level, and this objective can be accomplished by augmenting the storage chamber capacity with a supplemental reservoir or accumulator 137 of substantially greater capacity and connected to the supply pressure source as at 136. In this way, the effective head pressure delivered the nozzle orifice through passageway 105, which would otherwise decay as more and more of the air escapes from storage chamber 75, is continuously replenished by means of fresh air supplied from reservoir 137. The reservoir should be mounted as close as convenient to nozzle N, for example, below the same end of the lay as at 137 in FIG. 1, and connected to the nozzle by a line 138.

If the diaphragm were allowed to remain open a sufficiently long time, obviously, the decaying effect would occur even with the addition of the reservoir capacity but, with the limited operating times of the nozzle of the invention, it has been found that maximum operating head pressure can be sustained through the pulse with the addition of a reservoir capacity of about 80 $in^3$.

It will be recalled that the weft strand feed tube 111 extends through casing head 77 and conically shaped core plug 89, projects beyond the apex of the plug through the outer end portion of the bore 107 in core sleeve 85 to a point at least even with the outer face 88 of that sleeve. This means that the nozzle orifice opening 108 is necessarily in the shape of an annulus bounded between the exterior wall of the exposed end of feed tube 111 and the interior wall of the sleeve bore 107. It is an important feature of the present invention common to all embodiments of the weft insertion nozzle thereof that the area of the annulus at the point of least diameter of bore 107 constitutes the minimum area in the entire air flow path through the nozzle. The point of the minimum area of the air flow path defines the throat of the nozzle and a critical requirement of the invention is the occurrence of a choking effect in that throat. Given the re-entrant bend in the air flow path in the present nozzle, with the storage chamber 75 developed as an annulus around the bore 107 and its delivery passageway 105 and the converging nature of passageway 105, it follows that the point of minimum flow area occurs at the point of least diameter in bore 107 in the illustrated embodiments (the total effective flow area of annular passageway 105 being a function of its overall diameter as well as its annular radius). Where other design configurations are employed, the same result may not inherently follow but design of the nozzle in any case will have to comply with this requirement.

In addition, where the supplemental reservoir 137 is employed to augment the flow capacity of storage chamber 75 and thus maintain the full head pressure being delivered to the nozzle orifice, the conduit 138 connecting between the outlet of the supplemental reservoir and the port in the casing wall, together with these ports themselves, must have an effective flow area larger than the effective flow area of the nozzle throat. Since the duration of the air flow during weft insertion will ordinarily consume only a minor fraction of the total working cycle of the loom of the invention, the flow rate capacity of supply conduit connecting between the pressure source and the storage chamber, or the supplemental reservoir, when present, need not fill this same requirement, provided, of course, that in the available replenishment time (between nozzle firings), the amount of air delivered from the supply main to the reservoir and/or the storage chamber is adequate to restore their initial filled condition.

c. Pilot Pressure Control System for Insertion Nozzle

As previously indicated, the present invention imposes very stringent requirements upon the operating characteristics of the diaphragm valve in that the valve must have the capacity of responding in precisely reproducible fashion at a minimum frequency of 900 cycles per minute combined with an extremely short actuation time, in the order of one ms, and a special control system is provided for actuating the diaphragm valve in accordance with these requirements. The use of a directly operating solenoid valve for controlling pilot pressures acting to actuate the diaphragm valve of the invention, for example, is out of the question at the present state of the valve art. There are available solenoid driven control valves which are capable of a response time in the order of one ms, but these valves can pass only an extremely small amount of fluid in a given time, and this low transmission capacity would introduce such excessive impedance that the required rapid reaction of the diaphragm valve itself is impossible. Moreover, such fast acting solenoid valves are effective in only one direction and are characterized by a much slower response time, in the order of 5–6 ms, on their return stroke. Presently available solenoid valves with an air transmission capacity sufficient for purposes of the present invention have a response time in the order of 10 ms in each of their operating directions which would impose a minimum of 20 ms "delay" for each operating cycle and consequently inherently preclude the achievement of shorter response times.

(1) Electrical Embodiment

Figure 6:
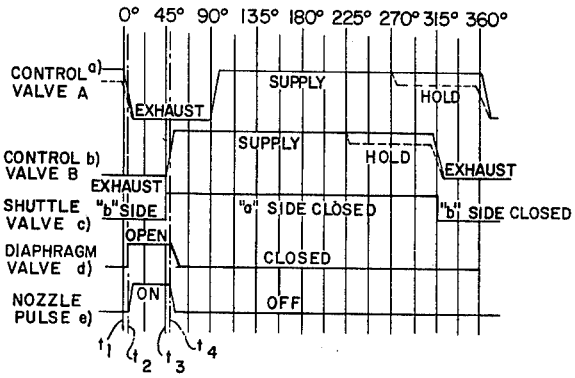
FIG. 6 is a wave form diagram illustrating the operation of the control unit of FIG. 5.

One embodiment of the nozzle control unit in accordance with the present invention, based on electrical principles is illustrated schematically in FIG. 6 and utilizes two separate solenoid valves 185*a*, 185*b* (represented diagrammatically) of suitable air transmission capacity connected to the opposite sides of a common shuttle valve 187 which in turn is connected at its output 189 to the pilot port 117 of the casing head 77 of the weft insertion nozzle. Upon electrical energization, each solenoid valve moves between a supply position connecting a suitable source of pressurized air to its outlet and an exhaust or "dump" position connecting its outlet to the ambient atmosphere, both valves 185*a*, 185*b* being biased to exhaust position and so shown in FIG. 6. The outlets 186*a*, 186*b* of the respective solenoid valves communicate with opposite ends of shuttle valve 187. Each side of the shuttle or piston 188 of valve 187 is effective by means not shown to close the corresponding end of the valve when unbalanced to that end. The outlet port 189 from shuttle valve 187 is located at its midpoint so that the shuttle or piston clears the outlet port in either of its extreme end positions. Hence, when the shuttle is in each extreme position, the outlet of one solenoid valve is in full communication with the shuttle valve outlet while the outlet from the other solenoid is closed by the shuttle. In this way, the shuttle valve isolates each solenoid valve from the other.

The function of this arrangement is illustrated schematically by the wave forms in FIG. 7. As indicated, each solenoid valve A, B moves between a supply position in which its wave form a, b is high and an exhaust position in which its wave form is low, the transition from these two positions being shown as a line sloping at an angle determined by the response time or lag of the solenoid. Wave form c represents the shuttle valve, side b of the shuttle being closed when the wave form is low and side a being closed when the wave form is high. The response of the diaphragm valve appears in wave form d, being closed when low and open when high. The actual nozzle output pulse is shown in wave form e, the nozzle being "off" (no air output) when form e is low and "on" (air pulse delivered) when form e is high. It is assumed that at the starting point, the diaphragm valve of the nozzle itself is in closed or seated position (and wave form d is low), while solenoid control valve A is in its supply position (and wave form a is high) connecting the supply pressure source to the "a" side of the shuttle valve, thus biasing the shuttle to its "b" side (and wave form c is low), closing off the outlet from the "B" solenoid valve, and establishing connection between the outlet of solenoid valve "A" and the shuttle valve outlet which applies control or pilot pressure to the control side of the nozzle operating diaphragm valve to maintain that valve closed (and wave form d is low). Solenoid control valve B is at this time situated in its exhaust or dump position (and wave form b is low). An operating cycle is initiated at a time $t_1$, indicated by a dash-dot line, to open the diaphragm valve of the nozzle by releasing the control pressure thereon, and solenoid control valve A is shifted electrically to its exhaust position, while solenoid valve B remains in its exhaust position. As a consequence, the shuttle valve remains at its "b" side position, but the control pressure acting on the diaphragm valve now begins to be exhausted to the atmosphere through the exhaust of solenoid A at some rate determined by the response rate of the solenoid valve as well as the inherent impedance, i.e. line resistance, etc., in the various connecting lines. Therefore, wave form a begins to fall at a sloping rate. When the control pressure acting on the diaphragm falls below a certain calculated level at a time $t_2$, the supply pressure in the storage chamber of the nozzle will then exceed the control pressure, forcing the diaphragm immediately into open position and wave form d goes high. The opening of the diaphragm valve admits pressurized air from the air storage chamber to the nozzle (and wave form e starts high at time $t_2$).

The diaphragm valve remains open, with the weft-projecting air pulse emitting from the nozzle, so long as both solenoid valves A and B are in their exhaust (i.e.

low) position; and in order to return the diaphragm valve to its closed position and end the nozzle pulse, solenoid control valve B is actuated electrically at a time $t_3$ to shift from its exhaust to its supply position. Thus, solenoid valve B, as seen in wave form b, makes its transition from exhaust to supply position, shown by the sloping line, the slope or rate of which is again determined by the response time of the valve and the impedance of the system as before. Since the opposite or "b" side of the shuttle valve is at this point in communication with the atmosphere, because of the exhaust position of solenoid valve A, there is no resistance to the shifting of the shuttle to the "a" side position (and wave form c abruptly goes high), and pressure begins to build up within the control side of the operating diaphragm of the insertion nozzle.

Figure 5:
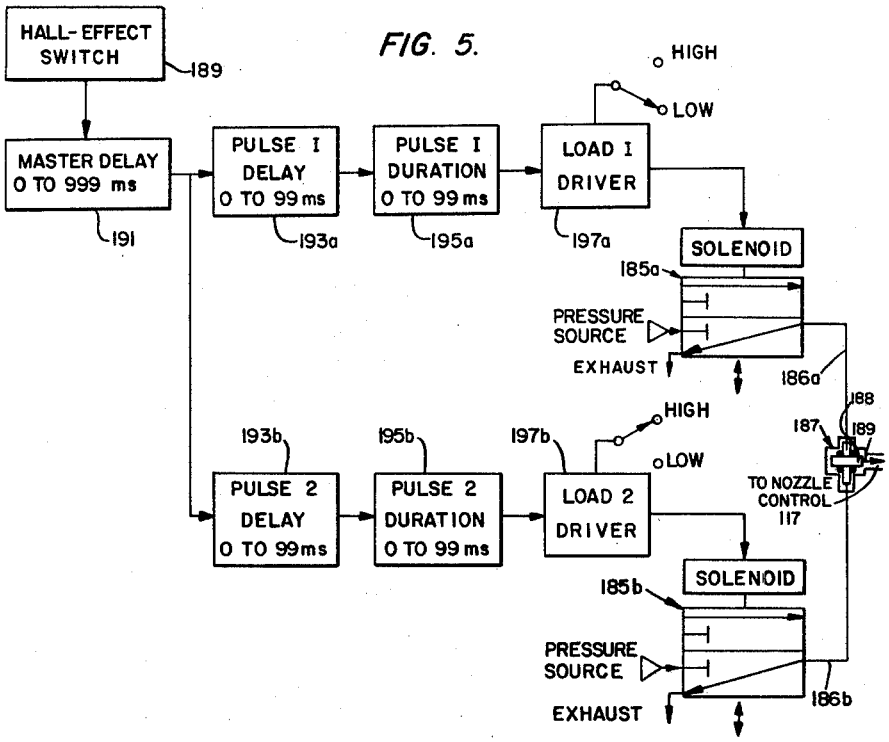
FIG. 5 is a schematic diagram illustrating an electonically actuated air control unit for the insertion nozzle of the invention.

At a certain time $t_4$, the control pressure will exceed the pressure in the storage chamber 75; and when this occurs, the diaphragm moves from its open to its closed position (and wave form d goes low). Since there is no "avalanching" effect in the closing of the diaphragm valve, as occurred in its opening, the closing response of the diaphragm valve is inherently somewhat slower than its snap action opening response (as seen in wave form d), but this has no significant effect on operating efficiency since some decay is unavoidable in exhausting residual air from within the nozzle passageways. It is, however, desirable that the closing response not be excessively long in order to minimize unnecessary consumption of air during each operating cycle, and the alternative nozzle embodiment of FIG. 5 is preferred because it allows the diaphragm to close at a lower level of control pressure and consequently with a higher rate of response. As the diaphragm valve closes, the nozzle pulse is shut off (and wave form e starts low at time $t_4$).

The signals used for controlling the actuation of the solenoid control or servo valves A and B of the embodiment of FIG. 6 are derived electrically as also shown in FIG. 6. Each operating cycle of the control system must occur in timed relation to the operating cycle of the loom itself. The control impulse for initiating each control cycle is preferably derived from the driving crankshaft of the loom itself. To this end, a so-called Hall effect switch 189 is associated with the crankshaft (not shown), this switch consisting of a magnetically operated switch arranged at a point adjacent the crankshaft and a small magnetic element carried on the periphery of the crankshaft itself so that upon each rotation of the crankshaft, the magnetic element passes the switch and activates it to transmit a control signal.

From the preceding discussion of the actuation of solenoids A and B, it will be realized that means must be present to actuate each solenoid control valve separately at preselected times which desirably are adjustable relative to one another. Also, the timing of the generation of the control signal during the loom operating cycle needs to be adjustable to regulate the timing of the firing of the weft insertion gun and achieve insertion of the weft at the optimum point in the loom operating cycle. This adjustability could be achieved mechanically by changing the location of either the switch or magnetic actuator of the Hall effect switch relative to the crankshaft periphery, but to do this conveniently would require a rather complicated mechanical arrangement, particularly since the loom crankshaft is ordinarily in a relatively inaccessible position. Moreover, a high degree of precision, i.e. within $\frac{1}{3}$ of a degree of rotation would be difficult to achieve in this way; hence, an electronic arrangement system for regulating the control signal is much preferred. To this end, a master delay timer 191 is connected to the Hall effect switch and consists of a plurality of, preferably three, decade counters (not shown separately), each adapted to count from 0 to 9 in intervals of 1 ms, and including an associated control dial for setting purposes, the counters being ganged together so as to count continuously from 0 to 999 ms to give an accuracy of 1 ms. Upon receiving the initial control signal from the Hall effect switch 189, the master delay timer 191 begins its counting operation and counts for a given number of microseconds as set on the control dial of its decade counters and after concluding such count, emits a control signal. In this fashion, the master timer, in effect can delay the transmission of the initial control signal in increments of 1 ms up to 999 ms for each loom operating cycle.

The control signal from master delay timer 191 is transmitted separately to each of the solenoid valves by means of separate solenoid control timers 193*a*, 193*b*, which are similar in arrangement and in function to master delay timer 191, making possible the regulated delay of the timer control signal in increments of 1 ms up to 999 ms (or a smaller or greater total if a coarser or finer degree of control is desired) and depending upon the delay interval set on the dials of the solenoid timers, each such timer will transmit a control pulse at a preselected given interval after receiving the common control pulse from the master delay timer.

The initial control signal generated by the Hall effect switch is of very brief duration and is not sufficient to maintain the actuation of each of the solenoids for the period of time that the valves of these solenoids must remain in open and closed position. Consequently, the control signal from each of the solenoid delay timers 193*a*, 193*b* is delivered to a pulse duration timer 195*a*, 195*b* which functions to prolong or "stretch" the pulse for a given period of time. The pulse duration counter is composed of a gang of two of the decade counters mentioned above to give a capacity of 0 to 99 ms delay in intervals of 1 ms (although a higher precision is obviously possible with additional decade counters if desired). Also, the power of the control signal is ordinarily of a low magnitude, as is true for most "logic" circuits, and is insufficient to electrically drive the solenoid. Each signal must, therefore, be amplified by a driver amplifier 197*a*, 197*b* which switches between high and low, i.e. on and off, conditions in response to the high or low state of the control signal, supplying sufficient power to the solenoid valve for effective electrical actuation thereof.

It will have been understood from the aforegoing description that a highly flexible and precise control system for the weft insertion nozzle is obtained by the just described arrangement. First, the operation of the diaphragm valve is independent of the response times of the individual solenoid servo valves either upon actuation or de-actuation. Since separate solenoids determine the application and release of the control pressure, the lag of the solenoid in returning to starting position is immaterial from the standpoint of any control function, provided, of course, that the lag of the selonoid is not so great that it cannot be returned to starting position in time for the next cycle. Secondly, while the actuations of the solenoid valves are caused fundamentally by crankshaft rotation of the loom, and are hence directly related to the loom operating cycle, the actual timing of such actuation is adjustable with respect to such rotation, giving complete flexibility in regulating the timing of weft insertion relative to the loom cycle. Finally, the timing of the actuation of each solenoid relative to the other is precisely variable and the duration of energization of each solenoid is independently adjustable with a good degree of accuracy.

Weft Metering and Storage

(1) Preferred Rotating Drum Embodiment

An important aim of the invention is, as already indicated, a reduction in the amount of waste involved in producing fabric in the system of the invention. If it were attempted to control the length of the weft strand inserted into the warp directly through timed actuation of the weft delivery clamp located upstream of the insertion nozzle, considerable practical difficulties would be entailed. First, even electrically, i.e. solenoid, actuated clamps designed for precision operation are not reproducibly accurate within ±1 ms and given the high velocity of the strand under the impetus of the firing of the insertion nozzle, variations in the order of a few ms can easily result in significant differences in the length of the delivered weft. For instance, with weft arrival times in the order of 30 ms, the weft is moving at an average velocity of about 2"/ms so that variation in clamp actuation time in the order of 3 ms would cause a dfference of 5–6" in the length of delivered weft.

Moreover, there is is an inherent randomness in weft delivery at the velocities in question where the delivery is from stored coils. For example, as strand coils are whipped free from storage at high velocities, they develop substantial inertial forces and consequently upon reaching a limit are subject to substantial overrunning, i.e. backlash, the effect of which is inherently variable, making it impossible to precisely fix the length of strand advancing from a coiled supply past a given point within a fixed period of time. Also, the uncoiling strand develops a balloon in its path from the supply and the drag resistance offered by the ambient air against this balloon is likewise variable and affects the instantaneous rate of travel of the strand.

To avoid these practical difficulties, a different approach has been taken in the invention in the control of weft delivery, based upon two simple fundamental principles. First, since the duration of each operating cycle of the loom is constant for a given operating speed, for instance 150 ms at 400 picks per minute loom operating speed, the exact length of weft required per loom cycle is fixed, and the weft feeding device can be adjusted to exactly meter out from a supply package that exact amount of weft during each operating cycle and deliver the same to a storage device. With, for instance, a cylindrical feeder, its diameter is, of course, known, and simple mathematics permits the calculation of the amount of rotation per cycle required to deliver a length of weft equal to the loom width. As the first principle, therefore, during each operating cycle of the loom, there is delivered to a storage device having a delivery point a length of weft equal to that consumed during the cycle, i.e. equal to the width of the loom.

Second, it is postulated that the collected weft strand be withdrawn entirely from the storage device during each operating cycle and be stretched out as straight as possible from the fixed delivery point through the insertion nozzle into the shed, free of coils, loops, slack and the like. If the exact amount of weft needed for each cycle is made available during each cycle, and if this amount of weft is actually withdrawn in entirety from the storage device during each cycle, then obviously the amount of withdrawn weft must be correct.

In compliance with these principles, the system of the invention includes a weft metering and storage unit shown in detail at FIGS. 14 and 15. This unit includes a generally cylindrical drum 300 having a polished peripheral surface and mounted upon the free end of a cantilevered shaft 302 having a driven gear 304 that is positively coupled, as indicated by broken line 306, to the driving crankshaft D of the loom to be rotatably driven continuously in synchronism with the loom crankshaft. The coupling can take the form of driving and driven pulleys connected by a timing belt, or alternatively of a variable speed transmission, so that the extent of rotation of the drum per loom cycle can be adjusted and thereby the linear distance of travel of a given point on the drum periphery per crankshaft revolution. The drum is disposed adjacent one side of the loom with its axis of rotation extending generally parallel to the axes of the lay and weft guidance tube (not shown in FIGS. 14 and 15). At its inboard end facing toward the shed, the drum preferably has a conical nose 308 to permit the strand to be withdrawn therefrom along its axis without engaging a sharp edge.

The outboard section 310 of the drum serves as a weft metering means which functions to withdraw at a determined rate a correctly metered length of weft from the weft supply package P, supported at a convenient location on the loom frame, and to maintain positive frictional engagement with the weft to thereby achieve such controlled advance and at the same time frictionally restrain the weft being delivered against slippage. The metering section of the unit can take several forms but preferably comprises a pinch roller 312 in pinching engagement with a locus on the periphery of the outboard section of the drum. The quantity of weft that is allowed to be present on the outboard metering section of the drum is not critical and can be varied widely. Good results are achieved in practice by applying two or more wraps or coils of the weft on this outboard section 310 in spaced apart, i.e. helical, relation, the number of wraps and extent of the spacing, i.e. the pitch of the helix, being determined by several spaced guide eyes or notches 314, the innermost of which is a closed guide eye 316 positively engaging the strand against axial withdrawal and constituting a fixed weft delivery point delimiting the metering section. Preferably, the pinch roller contacts several wraps of the weft, assuring good control over the weft during its delivery to the storage section and avoiding possible snarls, but other ways of maintaining the weft under control in this region are available and could be substituted.

Alternatively, if the weft is wound around the outboard section 310 of the drum in a number of wraps large enough to create sufficient frictional contact required for positive engagement of the weft by the drum, pinch roller 312 could be eliminated. However, the presence of the pinch roller is preferred since it guarantees that the weft advances linearly with the drum periphery and is not free to slip thereon. As a further alternative, a pair of feed rolls (not shown) engaging the weft in their nip could be employed for controlled delivery of the weft to the closed guide eye 316, but this would involve extra complications in synchronizing the rotational advance of such feed rollers with the drum rotation.

The inboard free end section 320 of drum 300 functions as a weft storage means, serving to collect upon its surface the length of weft which is delivered thereto by the metering section 310 by way of closed weft guide 316 which is the transition between the two sectons and establishes the outboard limit of storage section 320 of the drum as well as the inboard limit of metering section 310.

To insure that the coils formed by metering section 310 are delivered by the closed weft guide 316 in proper sequence on the storage section 320, a slightly downwardly and inwardly nclined shoulder or ramp 32 is formed on the drum periphery in approximate axial alignment with the closed guide 316. As a coil is delivered to the storage section, it contacts the ramp 322 and will be cammed inwardly thereby, leaving the ramp clear to receive the next collected coil. Otherwise, a subsequent coil night fall over or even inwardly of a previous coil and cause snarling. A preliminary guide 315 and tension 313 (see FIG. 15) precedes the pinch roller 312 to keep the weft from meandering laterally while advancing from the supply package P.

Upon leaving the inboard end of the storage section 320 of drum 300, the weft passes through a guide 324 arranged coaxially with the drum axis, the guide preferably being in the form of a closed eye disposed in the center of a vertically disposed plate 326. During the withdrawal of the weft coils from the storage section 320 during weft insertion, a balloon develops as at 328 in the weft path upstream of this guide eye, which defines the downstream limit of the balloon, and the plate 326 aids in preventing the balloon from overrunning the rest of the weft and creating tangles. Inboard of this balloon guide is a positively actuated weft delivery clamp 330 which can in practice be located on the lay just upstream of the insertion nozzle (not seen in FIGS. 14 and 15). At the operating speeds contemplated here, a fast response clamp is a requirement and, preferably, takes the form of a shoe 332 reciprocated by means of a solenoid 334 into contact with a fixed anvil 336. The solenoid 334 is actuated from the loom crankshaft as by means of a Hall effect switch, cam operated microswitch or the like (not shown) adjusted to actuate a relay and close the clamp at the desired time, any lag in the action of the solenoid being allowed for in setting the timing of the opening of the clamp which is not critical.

When the weft passes through the closed weft guide 316 into proximity with the rotating surface of the storage drum section 320, an air flow is created by the so-called Coanda effect which causes the weft to follow the moving drum surface. However, the strength of the Coanda effect is not sufficient to insure that after the stored length of weft has been withdrawn from storage section 320, an incoming fresh length of weft will again wrap around the drum, and in order to apply an additional wrapping force supplementing the Coanda effect, an additional circular air flow is provided.

To generate this added flow, an annular ring 340 encircles in closely spaced relation the storage section of the drum, the ring being hollow and generally toroidal in structure with its hollow core 342 acting as a manifold and connected to a source of pressurized medium, not shown. This medium is for all practical purposes air, and hence the ring will, for convenience be referred to as an air ring. The inner wall of the air ring is perforated by a series of uniformly circumferentially spaced slots 344 communicating with the hollow core 342 and delivering compressed medium therefrom into the annular gap 346 between the interior of the ring and exterior of drum storage section 320. The slots 344 are inclined from the radial from their manifold end inwardly in the direction of drum rotation, and a circular or vortical flow of air indicated by dot-dash arrows 348 is thus generated around the storage section of the drum urging the weft against the periphery of that section to be collected in a coil and maintaining such coil tight to prevent sloughing. Moreover, any slack that may develop in the weft due to relative motion between the insertion nozzle and the fixed drum is automatically taken up by the air ring flow and rewound upon the drum.

In operation, the strand from the supply package is preliminarily threaded manually through the preliminary guide, beneath the pinch roller, around the metering section the appropriate number of turns, through the fixed weft guide (and any intervening additional guides), the interior of the air ring, the balloon guide, the tension device, the delivery clamp and finally through the injection nozzle. Then the loom can be operated in the usual way. Once the loom is in operation, the drum rotates continuously with air being supplied to the ring continuously and after each length on the storage section is withdrawn therefrom during weft insertion, a new weft length is generated by the metering section and delivered to the storage section.

The combined force of the air ring flow and the Coanda effect can be varied and is sufficient to cause the weft to wrap upon the drum surface whenever its tension falls below a certain level in the range of about 1–5 grams, and this force is applied equally to the downstream as well as the upstream side of the strand. That is, the biasing effect will not only cause any freshly metered out strand to wind on the drum surface, it will equally cause any excess weft downstream of the storage drum section 320 to be wound on the drum surface which is useful in preventing strand kinking. However, this effect can also pull the strand backward and an important function of the weft delivery clamp 330 is to prevent the weft from being pulled back out of the shed after its insertion and coincidentally storage of weft for the next insertion is initiated. Obviously, the tension developed in the weft by the firing of the insertion nozzle greatly exceeds the biasing force of the air ring, but towards the end of the insertion phase, there naturally comes a time at which this tension has been dissipated and the inertia of the inserted weft falls below the biasing force of the air ring. If the weft remained free when this time is reached, it would be pulled out of the shed as the biasing force of the air ring takes over; hence the timing of the reactivation of the clamp must be set to occur before this point is reached.

Recalling that the pressure trace of the insertion nozzle firing pulse has a generally trapezoidal configuration, one will understand it is necessary for the clamp to be activated to close not later than a few ms, i.e. 2–5 ms, following the end of the firing pulse and preferably just slightly before the pulse has completely dissipated. On the other hand, actuation of the clamp while the nozzle pressure remains at significant levels is definitely to be avoided. If the weft is forceably restrained, by the clamp or otherwise, while being highly stressed by the blast of the insertion nozzle, then the weft tends to disintegrate because of the intense vortical forces it receives.

The release of the weft by the clamp for the next insertion step should likewise precede the activation of the insertion nozzle. As regards the timing of the reactivation of the clamp relative to the end of the insertion stage, when the stored weft coils are whipped free of the storage drum surface by the nozzle, the final coils tend to override the drum due to inertia as has already been mentioned, and it has been observed that an initial rise occurs in the tension in the moving weft, as detected by the tension detector 338 which is traceable to this backlash effect. Therefore, the actuation of the clamp should preferably be delayed for a few, e.g. 2–5 ms, after the earliest tension increase to allow this backlash effect to subside and the weft to assume its desired straightened out condition before being clamped. When the weft is drawn straight back to the fixed weft guide, a decided peak appears in the weft tension at the detector, and this indication can be used to establish the correct timed relationship for clamp operation.

In determining the length of weft provided by the storage drum section, one must keep in mind that the drum is operating continuously during the entire loom cycle so that an additional weft is being added to the storage drum section during the very period that the already collected weft length is being withdrawn by the insertion nozzle. However, by following the two simple principles explained above, the delivery system becomes self-regulating, in that with the correct amount of weft being transferred to the storage drum section 320 during each cycle and the length being withdrawn in entirety back to the closed weft guide, it becomes immaterial how much of the weft length is collected during the storage phase and how much is added during the weft insertion stage. This approach has the virtue of allowing a tolerance of a few ms without difficulty due to the relatively slow speed of travel of the weft during metering and storage versus its high rate during insertion. For instance, with a 48" loom and a 150 ms operating cycle time, the linear speed of the weft while being metered and stored is only about 0.3"/ms so that a variation of ±4 ms creates a difference of only about 1" in weft length.

Because of the extremely fast advance of the weft upon withdrawal from the storage section during nozzle firing, it may be desirable to apply a retarding force beyond the light tension of the detector 338 to the weft in the region between the balloon guide 324 and the delivery clamp 330 and a conventional tensioning device can be employed to augment the detector tension for this purpose. However, conventional tensioning devices are notoriously difficult to control precisely and are better avoided if possible. As an alternative, the advance of the weft from the storage section 320 can be retarded by increasing the separation between the inboard end of drum 300 and the balloon guide 324. This correpondingly increases the size of the balloon 328 and thus the resistance applied to the ballooning length of weft by the air and inertial forces.

(2) Alternative Fixed Drum Embodiment

As an alternative to the rotating drum unit described above, weft metering and storage can be carried out with a stationary drum unit similar in principle to the strand feeder disclosed in U.S. Pat. No. 3,776,480 to which reference could be made for a more complete understanding. In general, the alternative embodiment, as appears in FIGS. 16 and 17, includes a fixed support 360, which can be a bracket extending from the loom frame, and in this support is double-journaled one end of a rotatable shaft 362. A timing pulley 364 is affixed to the shaft between its journals for engagement by a timing belt 366 driven from the loom crankshaft (not seen) so as to create a positive mechanical drive between the crankshaft and the rotatable shaft. The free end of the shaft projects toward the loom in cantilevered fashion as at 368 inboard of support 360 to carry on its projecting end a generally cylindrical hollow drum 370 via intervening bearings 372 to permit independent relative rotation therebetween. The drum is formed of a plurality of segments 374 clamped between end walls 376, 377 in peripherally spaced apart relation to define a plurality, say six or eight, of axial slots 380 (see FIG. 17) uniformly around the drum periphery and a corresponding plurality of axially extending bars 382 fit freely in these slots. The axial bars are each integrally connected at about the midpoint of their inner sides to a common supporting spider 384 fitting within the interior hollow drum but free of connection with the drum segments. The spider is journaled via a bearing 385 on a bushing 386 keyed as at 388 to the shaft end 368, the periphery of the bushing being both eccentric, as indicated at 390, and slightly skewed or tilted relative to the shaft axis, as indicated at 392, so as to skew the axial bars in their slots. The drum is held against rotation by one or more fixed magnets 394 each supported adjacent the drum periphery from the end of an arm 396 projecting from the fixed support and attracting an associated magnet 398 recessed in one of the drum segments. Thus, when the shaft rotates while the drum/bar composite remains stationary, the spider 384 wobbles about shaft 368 imparting what is referred to as a "nutating" or "walking beam" motion to the array of axial bars 382 relative to the drum periphery which serves to gradually advance coils of a strand wrapped around the drum.

The outboard end of shaft 362 is hollow as at 397 to define an axial weft passageway for the weft advancing from its supply package (not seen in FIGS. 16 and 17) and communicates with the bore 399 of a radially and axially projecting hollow winding tube 400 having a free end 402 opening terminating adjacent the outboard end of the bar array 382. For purposes of the present invention, an arm 404 extends from the end of winding tube 400 to carry a closed weft guide eye 406 at a point along the length of the drum coinciding roughly with the midpoint of the axial bars.

The inboard end wall 376 of the drum is surrounded by an air ring 407 similar in design and operation to the air ring of the rotating drum embodiment, and beyond the air ring, the end wall has a tapered axial extension 408 to facilitate smooth passage of the weft thereby. A balloon guide eye 410 similar to the balloon guide eye of the previous embodiment is arranged in spaced coaxial relation to the inboard end of the drum to guide the weft to the nozzle.

The outboard axial section **374*a* of the drum-bar composite between the winding tube end 402 and the closed guide eye 406 functions in operation as the metering section of the unit, receiving the weft delivered thereto from the weft supply package via the winding tube 400, the winding tube being rotated the correct number of turns per loom cycle in relation to the diameter of the drum-bar composite to wind upon the drum the desired length of weft for that cycle. The inboard axial section 374*b* of the drum between the closed weft guide eye 406 and the air ring 407 functions as the storage section for holding the length of weft which is withdrawn by the insertion nozzle, the closed guide eye 406 forming the transition between the metering and storage sections and limiting axial unwinding of the stored coils during insertion. The weft guide eye 406 rotates bodily with the winding tube and, in effect, progressively transfers wraps or coils of the weft previously applied to the metering section onto the storage section, while the winding tube lays down fresh wraps of weft upon the metering section. The "nutating" motion of the bar array relative to the drum periphery serves to space the coils about 1/16–3/32" apart dependent upon the skew and to gradually advance the coils axially along both the metering and storage sections and maintain these coils in helically separated condition. The aggregate number of wraps of weft upon the two sections is sufficient to exert enough frictional force upon the weft in such coils as to hold the coils against slipping around the drum following the rotating winding tube, and consequently, fresh weft is drawn from the supply into and through the bore 399 of the winding tube as the latter rotates about the drum in timed relation with the rotation of the crankshaft of the loom. Inasmuch as shaft 362 rotates at a considerable rate, e.g. several thousand rpm, in operation, careful balancing is critical to vibration-free operation and weights 412, 414** can be provided for counterbalancing purposes at appropriate points.

Air ring 407 functions in the same manner as before to retain the weft coils on the storage section of the drum and remove any slack that may form between the injection nozzle and the closed weft guide eye 406.

Weft Reception and Arrival Detection

In order to insure that the leading end of the weft after insertion through the shed is engaged and contained during beat up of the weft, a hollow weft reception vacuum tube generally designated V is mounted on the end of the lay opposite the insertion nozzle, the tube being open at one end located adjacent to and facing that side of the shed and connected at its other end to a source of vacuum (not shown) maintaining a negative pressure in the tube of about 20" water. One preferred embodiment of vacuum tube V is shown in FIG. 18 and in this embodiment the end of the tube adjacent the shed is elongated or flattened as at 440 (see also FIGS. 2A and B) in a generally vertical direction parallel to the plane of the reed R to concentrate the suction force. To reduce the possibility of the leading weft end missing this slotlike opening having a width of about ⅜", a laterally projecting flange 442, 444 extends from either side of the opening to increase the "target area" of the opening. The effect of these flanges is to momentarily halt the movement of the weft end if it should miss the tube opening, which is enough for the suction in the tube end to attract the weft end therein.

It is advantageous for the arrival of the weft at the reception tube to be positively detected. In the event the weft end does not completely traverse the shed, which can occur when the weft end becomes entangled upon itself, the result is a defect in the woven fabric which can become permanent if weaving is continued. To this end, a photoelectric detection unit can be provided at the reception side of the shed and is preferably associated with a modified form of reception tube V' seen in FIG. 19. In this embodiment, the tube itself is circular as at 440' and telescoped over its open end is an enlarged collar 446 of generally oval or rectangular shape having a vertically elongated aperture 448 in its center communicating with the suction tube and defining the weft entry slot. The sides 442', 444' of the end face of the collar serve as the weft intercepting flanges, and the edge around the inlet opening can usefully be beveled or rounded as at 450 to further assist entry of the weft end. Integrated into the collar is a vertically spaced array of minute photoelectric beam generators 452 and associated transducers 454 disposed along opposite sides of the elongated entry slot at a plurality, say three, of vertically spaced points. The response of such a multi-cell array is more reliable than a single large cell, the minute cells being more sensitive to interception by a small thread while the multiplication of the cells increases the likelihood of the weft being detected. As will be described more fully in connection with the electrical circuit diagram of FIG. 21, the outputs of the photoelectric detection transducer are amplified and transmitted through an appropriate circuit to a solenoid-operated clutch (not shown) controlling the power transmission from the loom motor to the loom crankshaft to bring the loom automatically to a halt in the event a signal pulse from one or more cells indicating the arrival of the weft fails to be received within a set interval of the loom operating cycle. That interval can vary but preferably begins when the shed opens to the extent permitting weft insertion, i.e. at about 140° of the cycle, and terminates at the front dead center position of the loom with the lay in its full beat up position, i.e. at 360°. This interval can be established by means of switches and activated from the loom crankshaft at the appropriate points of its rotation.

As is evident from the end view of the reception vacuum tube 440, 440' seen in FIG. 2A, the axis of the 440, 440' during weft insertion must be generally in registration with the axis of the interrupted weft guidance tube T within the open shed S, which axis is necessarily spaced forwardly of the plane of the reed R. Hence, if the reception tube remained fixed in this position during beat up, its axis would lie forwardly of the fell of the fabric (which coincides with the plane of the reed at front dead center) and since the free length of weft projecting outside the shed is made as short as possible, say 1 to 1 1½" so as to minimize the waste resulting when such projecting lengths are eventually sheared from the fabric, and the fed weft ends could consequently be pulled out of the reception tube inlet as the lay approaches front dead center, this would result in loss of engagement with the free weft end at the very moment such end needs to be positively restrained for purposes of selvage formation.

Preferably, therefore, the reception tube is mounted for limited independent relative displacement upon the lay as appears in FIGS. 2A and 2B. To this end, a bracket 460 is affixed to the end of the lay and upon this bracket is pivoted a generally vertically arranged bell crank lever 462 carrying the suction tube 440 at its upper end. The lower end 464 of the bell crank lever is linked to a collar 466 fixed to one of the guide rods 55 forming part of the vertically displaceable support for the interrupted weft guidance tube T. Thus, as the lay rocks rearwardly and guide rods slide upwardly to introduce the weft guidance tube into the opening shed preparatory to the weft insertion, collar 466 also moves upwardly to rock bell crank 462 forwardly and bring the suction tube 440 into alignment with the guidance tube axis. Contrariwise, as the lay swings forward to beat up position and the weft guidance tube is withdrawn downwardly below the shed, the bell crank 462 is rocked rearwardly to displace the suction tube axis rearwardly of the guidance tube axis and into coincidence with the plane of the reed which is possible since the suction tube is located outside the end of the reed. Any lateral offset between the location of the collar 466 and the bell crank 462 can be bridged by extending one or more pivot shafts.

For some purposes, the engagement of the weft free end by the suction in the weft reception tube is desirably augmented by means of a positively activating weft end clamp 470 (see FIGS. 18, 2A and 2B). Such a clamp can be built into the reception tube by cutting a slot in one side of the tube 440, as at 472, for the projection therein of a weft clamping pad 474 carried at the upper end of an upstanding finger 476. Finger 476 is pivotally mounted at its lower end 478 to the bell crank 462 so as to be movable bodily with the bell crank and the reception tube 440 carried thereby while also capable of limited independent pivotal movement. Below the pivot point the finger includes an angularly forward extension 480 which is adapted to engage an adjustable fixed stop 482 on the lay when the bell crank 462 is in forward position (and the lay is in rearward position) during weft insertion, thereby swinging the clamping pad 474 out of the tube slot 472 and allowing the weft end to freely enter the reception tube opening. Then, when the bell crank 462 pivots rearwardly during beat up, finger 476 rocks with it which lifts extension 480 away from the stop 482, allowing finger 476 to be biased forwardly by a spring 484 toward the reception tube seat 472 to bring pad 474 into engagement with the inside wall of the tube with the weft end gripped therebetween.

Air Circuit

To aid in an understanding of the manner of operation of the invention, an "air" circuit diagram for the pneumatic components is shown in schematic fashion at FIG. 20. In this diagram, air from a suitable original pressure source (not shown) is passed through a coarse filter 510 to remove oil contamination and solid particles such as dust and the like, above say 20$\mu$ in size, and then is delivered to a high pressure line 512 and a low pressure line 514, the pressure in which are determined by high pressure and low pressure regulators 516, 518, respectively.

High pressure line 512 has several branches, the first of which 520 communicates directly with the storage chamber 75 of the insertion nozzle N or, more preferably as shown, with the air accumulator 137 and through that accumulator with the nozzle storage chamber. A second branch 522 passes through a solenoid operated valve 524, movable between a delivery and an exhaust position to a clutch (not shown) in the drive of the weft metering and storage unit so as to disengage that clutch and stop further accumulation of weft on that unit when the solenoid valve is activated during, for example, backing up of the loom to repair a broken or incomplete weft.

Another branch 526 passes through a fine filter 528 capable of removing particles down to about 3 micron and then connects with the inlet of the weft insertion nozzle control unit U (shown as the embodiment of FIGS. 8–10) for delivery under the control of that unit to the pilot control inlet 117 of the insertion nozzle N itself. A fourth branch 530 passes through a manually energized solenoid valve 538 having delivery and exhaust positions, and on to a feed port (which can be the same as pressure tap port 181) in the supply passageway of the nozzle so as to allow bursts of air to be emitted from the nozzle opening by direct operator actuation of valve 538 independently of the nozzle control unit U itself. The low pressure line feeds continuously to the air ring 340 of the weft metering and storage unit.

Electrical Circit Diagram

An electrical circuit diagram for the electrical components of the air circuit diagram and other related components (exclusive of the electrical embodiment of control unit U) is seen in FIG. 21.

As already mentioned, it is possible to operate the weft delivery clamp by a spring-return solenoid energized by a microswitch contacted by a rotary cam rotating with the loom crankshaft and contoured to open and close the switch and thus the clamp at the proper times. Obviously, however, it would be complicated to adjust these times with such an arrangement. It is preferred, therefore, to operate the weft delivery clamp with two separate oppositely driving solenoids which are coupled together and to the clamp head and are energized alternatively in correctly timed relation. To this end, as shown at the bottom of FIG. 21, separate clamp opening and clamp closing switches 550 and 551 are each connected on one side to a 12 volt D.C. line 549 and on the other side to a different side of an integrated circuit flip-flop 552. Each of the outputs of the flip-flop is connected to the base of an associated power transistor 555, 556 is connected in series to one side of a corresponding solenoid 557, 558 having its other side connected to the D.C. line 549 to complete the circuit. When the clamp open switch 550 is closed, transistor 555 is activated to permit current to flow through solenoid 557 to open the weft delivery clamp; while, conversely, when clamp closing switch 551 is closed, transistor 556 is activated to allow current to flow to the solenoid 558 to close the weft delivery clamp.

A preferred arrangement for operating switches 550, 551 appears in FIG. 37 wherein switches 550, 551 take the form of Hall effect switches mounted at radially separated points on corresponding arms 559, 560 pivoted on a shaft 561 rotating with the loom crankshaft. Magnetic acutators 564, 565 are carried on separated discs 562, 563, fixed to the shaft 561 for rotation therewith, at corresponding radially separated points so that each of the actuators rotates in a circular path coinciding with only one Hall effect switch.

As stated, close control, within 1–2 ms, of the actuation of the weft delivery clamp can be important, and the open interval of the weft delivery clamp must be adjustable. Gross adjustment of the relative positions of magnetic actuators 564, 565 is possible by means of a clampable pin and slot connection 566. In addition, fine adjustment is achieved by forming the ends of the arms 559, 560 as gear segments as at 567, 568, for engagement with pinions 569, 570 fixed on the frame of the loom and secured by spring-biased detents (not shown) in any rotation position. The arms pivot independently on shaft 561 and by turning the pinions 569, 570, the relative peripheral positions of the arms and thus of the Hall effect switches themselves can be precisely adjusted.

A loom normally incorporates a so-called loom stop motion connected between a 12 volts A.C. source and ground and including a mercury switch 540 associated with the operating position (being shown normally closed in FIG. 21). A drop wire switch 542 responsive to the warp drop wires (not shown) to be closed when a warp thread breaks is connected in parallel to a manual loom stop switch 543, and both are in series through switch 540 with the loom "stop" solenoid 544 controlling a clutch (not shown) transmitting power from the loom motor to the loom crankshaft so as to automatically stop the loom when any warp strand breaks during operation or manual stop switch 543 is closed. This circuit is conveniently used in the present invention for stopping the loom in the event the photoelectric weft detector array in the reception tube fails to detect the arrival of the leading weft end at the proper time. To this end, the output of a triac or bi-directional thyristor 546 is also connected in series with the stop solenoid 544 through the mercury switch 540, being in parallel with the drop wire switch 542 and the manual stop switch 543. The output of photodetector, emitter-transducer array 452, 454 (FIG. 19) is amplified for practical reasons by an operational amplifier 545 and applied to the S input of an RS flip-flop 537 having its Q output open and its $\overline{Q}$ output connected to one side of an AND gate 534. A resetting pulse is derived from the clamp open switch 550 and after being stretched in a pulse stretcher 531 is applied to the R input of flip-flop 547, the duration of the stretching extending until a few ms after front dead center of the loom. A timing pulse derived from the clamp close switch 551 is delivered to the other side of AND gate 534 after being delayed as at 532 so that its arrival coincides exactly with front dead center of the loom. The output of AND gate 534 is applied to the trigger of triac 546.

Unless interrupted by the arrival of the weft, the photoelectric array is continuously conducting and the S input of the flip-flop remains at logic 1 which holds the $\overline{Q}$ output at logic 1 and the Q output at logic 0. Thus, if no weft has arrived by the time the loom reaches front dead center, both inputs of the AND gate are at logic 1 and a pulse is passed by that gate to trigger the triac and actuate the stop motion solenoid. If a weft does arrive, a momentary logic 0 is received at input S which activates the flip-flop to make $\overline{Q}$ go to logic 0 and Q go to logic 1. Since the pulse stretcher 531 holds input R at logic 1 until after front dead center, the flip-flop holds $\overline{Q}$ at logic 0 irrespective of subsequent fluctuations of the R input between logic 1 and logic 0. Upon the termination of the stretched reset pulse, input S returns to logic 0 which resets the flip-flop to make $\overline{Q}$ go to logic 1 and Q go to logic 0.

If the weft arrival detection array should become disabled, the loom is automatically stopped since any interruption in the photoelectric output activates flip-flop 547. When the loom is operated to correct the defect due to weft nonarrival or other problems, mercury switch 540 will be opened to disconnect the stop solenoid and simultaneously reset triac 546.

A loom back-up switch 548 on the operating handle supplies A.C. current to the weft feeder clutch solenoid valve 524 so as to disengage the weft feeder clutch and avoid entanglement or further accumulation of weft on the feeder while loom crankshaft is moved manually to make necessary repairs to fabric or loom. Similarly, solenoid 538 which controls a valve for admitting feeding air directly into the insertion nozzle independently of the nozzle control unit U is connected to the same power line on one side and on the other to a manually operated switch 547 and thence to ground. The operator by closing switch 547 can admit a pulse of air directly to the nozzle to project a weft during initial threading up.

The aforegoing description omits descriptions of an alternative embodiment of the weft injecton nozzle forming part of the present invention, alternative embodiments of control systems for regulating the supply of pressurized air to the injection nozzle, which alternative embodiments operative along mechanical rather than electrical lines, as well as several other improved features of the present overall air weft insertion system which are not directly germane to the particular subject matter forming the invention of this application. For an explanation of the details of these other embodiments and features, reference may be had to the full disclosure thereof appearing in the above-identified application Ser. No. 64,180, the pertinent sections of which are hereby incorporated by reference.

II. Operation of the System of the Invention a. Introduction

In the course of the preceding detailed description of the appartus of the system of the present invention, considerable information has already been conveyed, either directly or indirectly, as to the mode of operation that is followed in the practical utilization of this apparatus. However, certain process conditions are of peculiar importance in the invention and need more detailed description augmented with actual test results.

Some preliminary general comments might be helpful to an understanding of the results of these tests which, basically, involve the projection through the warp of a standard 48" loom of a proper length of yarn drawn from the weft metering and storage device described above through a "standard" weft guidance tube utilizing a given combination of nozzle configuration and test conditions. For this purpose, a "standard" guidance tube is 48" in length, composed of 310 equally spaced annular elements, one for roughly every 12 warp strands, each $\frac{1}{8}$" in thickness (i.e. axial dimension) and having a $\frac{3}{4}$" diameter honed internal bore. For each test, the supply chamber of the nozzle, and the accumulation reservoir where present, are pressurized with air to a given "supply pressure" by an uninterrupted connection to a pressure main of the same pressure, and the actual values of the "supply pressure" are measured by means of a pressure gauge (not shown) communicating with the interior of the nozzle supply chamber. A feed tube having an outside diameter of 0.095" is arranged within each nozzle with its free end projecting approximately 1/8" beyond the plane of the exit of the contoured section exclusive of the extension barrel where present, and the weft to be projected is introduced into the feed tube with its leading free end projecting a short distance, e.g. approximately 1", exteriorly of the feed tube end, and simulating a practical weaving condition where the weft is cut between the nozzle and fabric edge.

After the nozzle has been activated or "fired" with a sufficient level of supply pressure, the weft length will be projected through the nozzle and into the guidance tube. For a given nozzle arrangement and set of test conditions, the time required for the free end of the weft length to traverse the entire length of the guidance tube and emerge from the far end thereof has been found to be reproducible with a reasonable level of accuracy, and this time, referred to herein as the "weft arrival time" is a useful characteristic in evaluating the effectiveness of the particular test conditions. For consistent evaluation, a distance of 52" has been fixed as a practical test distance the weft must travel for measuring these weft arrival times, ths distance including the guidance tube itself and sufficient clearance space at either end to approximate what would be needed in actual practice on a 48" loom.

The technique used for measuring the "weft arrival times" is as follows: A stroboscope is located at the fixed test distance from the nozzle (outside the egress end of the guidance tube), the stroboscope being activated by means of an adjustable interval timer, calibrated in microseconds, which is started by the firing of the nozzle itself so that the strobe flashes after passage of whatever interval of time is set on the timer following the instant of nozzle firing. The egress end of the tube is then visually observed by a human observer to see the location of the leading end of the weft when the stroboscope flashes. The test is repeated with appropriate adjustments of the timer by trial and error until the leading end of the weft can be seen just reaching the 52" test point at the moment of the flash. This technique is simple with a good degree of reproducibility virtually free of human error and can easily be recorded for subsequent confirmation with a camera viewing the test point. Once the timer reading matching the instant of arrival of the weft is formed, the test is repeated once of more times to insure accuracy. When measured in this fashion, weft arrival times accurate to 1 millisecond (ms) have been obtained with reasonable consistency.

The firing of the nozzle will deliver a burst of air into the guidance tube and the emergence of this flow of air can be detected (and actually felt by hand), and, here again, the time required for the air current to traverse the given fixed distance, namely 52" is generally reproducible for a given set of conditions and has been found to provide an indication of the maximum theoretical efficiency that a given arrangement is capable of achieving under a given set of conditions. The period of time for the air burst to pass through the tube and reach the fixed end point is referred to herein as "air arrival time" and is preferably measured by means of a hot wire anemometer situated at the fixed point and connected to the recording oscilloscope measuring the lapse in time in milliseconds between firing of the nozzle and response of the anemometer. As is known in the art, a hot wire anemometer changes in electrical resistance in response to fluctuations in its ambient temperature, which resistance changes can be detected by a recording oscilloscope. Since a change in the velocity of air ambient to the hot wire produces a temperature fluctuation at the wire, this device effectively detects the instantaneous arrival of the air flow at the fixed point.

As is well known from the principles of fluid flow, the pressure which is actually delivered to the throat of a nozzle is virtually never the same as the supply or line pressure since the pressure level which can be "seen", i.e. received, by the nozzle throat will necessarily be affected by the inherent resistance of impedance in the connections existing between the supply lines and the nozzle itself. The term "head pressure" or "stagnation pressure" is used in the art to differentiate actual nozzle pressure from supply or line pressure, and this distinction is followed here. Specifically, the term "head pressure" or the equivalent "stagnation pressure" as employed in describing the various tests carried out here is intended to mean the pressure measured by a strain gauge pressure transducer mounted about the midpoint of the delivery passage of the nozzle upstream of the throat, as indicated roughly by the dotted lines designated 114 in FIG. 4, the signal from this transducer being delivered to a recording oscilloscope. On the other hand, the term "supply pressure" is that pressure measured by a gauge connected to the supply chamber which will be in equilibrium with the line pressure before nozzle activation.

With these preliminary explanatory observations, the discussion will now address particular operating conditions.

b. Nozzle Pressure

It is of critical importance to the present invention that the "head pressure" of the nozzle be sufficiently large to achieve a "choking" condition at the throat of the nozzle itself and not upstream or downstream of the nozzle throat. The term "choking" has been derived from the field of aeronautical testing, e.g. wind tunnel testing, and is accepted to mean the delivery to the nozzle of air under sufficient pressure that the velocity profile across or transversely of the air flow passing through the throat area uniformly equals sonic velocity, i.e., has a velocity of Mach No. 1.0. Generally, it is known that a nozzle throat will be "choked" in this sense when the ratio of the head or stagnation pressure actually available to the throat itself to ambient pressure is at least 1.894/1. Contrary to the experience of aerodynamic testing where choking is an undesirable phenomenon, it is essential in the practice of the present invention that a choking condition be produced directly in the nozzle throat and not before or after that throat in order to maximize the thrusting capability of the nozzle upon the strand disposed therein.

Thus, the throat of the nozzle of the present invention must constitute the point at which maximum impedance occurs within the delivery connections between the pressure source and the nozzle throat, including impedance due to turbulence of flow as well as boundary layer phenomena. By the term "boundary layer phenomenon" is meant the tendency of a layer of fluid adjacent a stationary surface or boundary to be substantially stationary and exert resistance to the flow of fluid along that surface, the extent of such resistance increasing as the surface length increases. To this end, the air supply components of the present invention are especially designed to allow air to flow therethrough with minimum impedance losses of all kinds, the distances between the pressure supply source, i.e. the supply chamber and accumulator and the nozzle being as short as reasonably possible, and all connecting lines being of sufficiently large size as to eliminate significant impedance. Further, the delivery passageways extending from the supply chamber to the throat are carefully contoured for turbulent-free flow together with sufficient circumferential dimension as to substantially exceed, e.g by a factor of about 5, the actual throat cross-sectional area, notwithstanding roughly equal radial or annular dimensions, bearing in mind that the annular throat area of the present nozzle is reduced by the presence of the feed tube therein.

As already stated, the basic determinant of nozzle choking is the existence of a pressure relationship between the nozzle head pressure and the ambient atmosphere in the order of approximately 2:1, and the achievement of this ratio is the prime indicator of the occurrence of a choking condition. However, additional indications of this condition are provided by the quantitative relationship of the head pressure to the supply pressure, in that the head pressure for a choked nozzle will tend to more closely approach the supply pressure and by the pressure "history" for the nozzle obtained during a cycle of operation. If the pressure transducer communicating with the nozzle delivery passage just upstream of the nozzle throat is used to continuously record on an oscilloscope the pressure at that point during an operating cycle, the pattern of this recording gives a pressure trace or 37 pressure history" which reveals significant information about the nozzle, as will be explained.

Where the nozzle length is extended to project, e.g. by means of a barrel, downstream of the throat region which can be advantageous for certain purposes, care must be taken to insure that the length of such extension is not such as to superimpose upon the system a subsequent or downstream "choking point" that would defeat the critical requirement of the invention of choking directly at the throat. The boundary layer effect in an extended cylindrical tube introduces an increasing resistance or impedance according to the tube length, which is comparable in effect to a physical restriction analogous to a throat, and this effect cannot be permitted in this invention to develop to the extent of creating a "virtual throat" smaller than the downstream of the actual throat.

In order to give a comparison between a variety of different nozzles for the purpose of the present invention, extensive testing has been carried out with nozzles of different contours and dimensions, and the results thereof appear hereinafter.

c. The Nozzle Contour

For purposes of this invention, the contour of the nozzle does not appear to be critical and is subject to considerable variation. Early in the research underlying this invention, the hypothesis was drawn that a nozzle designed to produce supersonic air flow would be distinctly advantageous, if not crucial, to optimum high speed projection of weft strands in a loom. Subsequent working data have disproved this hypothesis in that while a nozzle designed for supersonic flow is certainly suitable for the practice of the invention, virtually the same operating efficiency can surprisingly be attained by nozzles which are not designed for supersonic flow.

(1) "Supersonically Contoured" Nozzle

The design of the nozzle contoured for supersonic flow has been thoroughly explored in the aerodynamic field and requires no detai3ed explanation here. Briefly, a so-called supersonic nozzle requires an outlet opening located downstream of a converging throat, the ratio of cross-sectional areas of the outlet opening relative to the throat being greater than 1, with the interior nozzle wall in the region between the throat and outlet being smoothly diverging in contour. With such a nozzle, the air flow at the throat reaches sonic velocity and, if pressurized sufficiently, upon entering the downstream divergent area will undergo an expansion with consequential acceleration to above sonic speeds. The degree of expansion and consequential flow acceleration determines the maximum velocity capability of the nozzle, i.e. its effective Mach number, and each nozzle must have its design parameters carefully selected in accordance with its intended design Mach number capability when operated at a given design pressure level. It is preferred that the divergent contouring be such as to produce flow expansion under carefully controlled conditions to thereby preclude the possibility of so-called shock wave formation caused by undersirable over expansion and subsequent collapse or recompression of the flow current to restore equilibrium. Also, the exit pressure at the outlet opening should ideally speaking, exactly equal atmospheric pressure for the same reason of avoiding shock wave formation. Calculations establishing the precise contours required for supersonic nozzles over a range of Mach number capabilities have been evolved in the aerodynamic art and additional practical information on this subject can be found in the paper "The Design of Supersonic Nozzles" by A. McCabe, the British Aeronautical Research Committee (BARC) Reports and Memoranda, No. 3340, 1967, while a theoretical treatment appears in the text *Aerodynamics of a Compressible Fluid* by Leipmann and Puckett, John Wiley & Sons, New York, 1947, especially pages 30–37 and 218–232. For present purposes, precise application of these calculations has not been found essential and an approximation acceptable for the invention can be obtained by simply establishing (e.g. with so-called "French curves") a smoothly curved divergent contour between the throat area and the exit opening of the nozzle.

To demonstrate the behavior of supersonically contoured nozzles, which for convenience are referred to here as "contoured nozzles", a series of tests was carried out with a given contoured nozzle alone and modified by the addition of extension barrels of varying length, such barrels being uniformly cylindrical in shape with a diameter matching the exit diameter of the nozzle and a length related to the nozzle exit diameter by factors of 5, 10 and 20, respectively. The nozzle in this case was designed with a throat cross-sectional area of 11 $mm^2$, a throat diameter of 0.175", and an exit diameter of 0.186" to give Mach number of approximately 1.5 for a "design" stagnation pressure of 39.3 psig. The axial distance between the plane of the throat area and the plane of the exit opening is 0.120", and the nozzle surface is smoothly contoured in divergent fashion from the throat to the exit opening. The test results for these nozzles operated at supply pressures ranging from 40 to 120 psig, in 10 psig increments, in terms of air arrival times, weft arrival times as well as the effective head pressures attained appear in Table I below, while the data from this table for weft and air arrival times versus supply pressure for all four nozzles is plotted in FIG. 22, the respective nozzles being designated according to the legend appearing on that figure.

TABLE I

Effect of Extension Barrels on Contoured Nozzle

| Supply Pressure | Air Arrival Time (ms) | | | | Weft Arrival Time (ms) | | | | Head Pressure (psig) | | | |
|---|---|---|---|---|---|---|---|---|---|---|---|---|
| | No Bbl | 5 × D Bbl | 10 × D Bbl | 20 × D Bbl | No Bbl | 5 × D Bbl | 10 × D Bbl | 20 × D Bbl | No Bbl | 5 × D Bbl | 10 × D Bbl | 20 × D Bbl |
| 40 | 37 | 35 | 34 | 35 | NA | NA | 56 | 58 | NA | NA | 40 | 39 |
| 50 | 30 | 30 | 30 | 32 | 98 | 45 | 42 | 42 | 48 | 48 | 48 | 50 |
| 60 | 27 | 27 | 26 | 28 | 53 | 36 | 36 | 34 | 57 | 57 | 60 | 59 |
| 70 | 26 | 24 | 25 | 25 | 50 | 34 | 30 | 30 | 67 | 68 | 70 | 68 |
| 80 | 24 | 23 | 23 | 24 | 44 | 33 | 29 | 27 | 78 | 78 | 78 | 78 |
| 90 | 23 | 22 | 22 | 23 | 33 | 27 | 27 | 26 | 88 | 90 | 90 | 87 |
| 100 | 21 | 21 | 20 | 22 | 29 | 27 | 26 | 23 | 99 | 99 | 98 | 97 |

TABLE I-continued

| Effect of Extension Barrels on Contoured Nozzle | | | | | | | | | | | | |
|---|---|---|---|---|---|---|---|---|---|---|---|---|
| | Air Arrival Time (ms) | | | | Weft Arrival Time (ms) | | | | Head Pressure (psig) | | | |
| Supply Pressure | No Bbl | 5 × D Bbl | 10 × D Bbl | 20 × D Bbl | No Bbl | 5 × D Bbl | 10 × D Bbl | 20 × D Bbl | No Bbl | 5 × D Bbl | 10 × D Bbl | 20 × D Bbl |
| 110 | 20 | 20 | 19 | 21 | 27 | 25 | 23 | 23 | 110 | 108 | 110 | 108 |
| 120 | 18 | 19 | 18 | 19 | 26 | 23 | 21 | 21 | 120 | 120 | 120 | 120 |

The indication "NA" means "no arrival", i.e. the weft length could not be projected across the 52" test length at the corresponding condition.

From the data of Table I several conclusions can be drawn. The effect on the air arrival times across this broad supply pressure range of the addition of extension barrels to a contoured nozzle is minimal—the curves representing air arrival times for the four nozzles cluster closely together and are very likely within the range of experimental error. However, the addition of an extension barrel significantly improves weft arrival times for the particular contoured nozzle of this test when operated at low supply pressures, this nozzle having poor efficiency at such low pressures, the difference in barrel lengths having relatively small significance. At higher operating pressures, on the other hand, the unmodified contoured nozzle, i.e. without an extension barrel, operates nearly as efficiently as the extended contoured nozzles. It will be seen that the head pressures achieved by this group of nozzles come close to the corresponding supply pressures; thus, essentially all of the energy of the supply pressure was effectively delivered directly to the nozzle with little measurable impedance indicating the occurrence of choking at the nozzle throats irrespective of the absence or presence of an extension barrel.

(2) "Straight" Nozzle

In addition to supersonically contoured nozzles, there have also been tested for purposes of this invention nozzles which instead of being contoured divergently downstream of the convergent throat area, extend cylindrically, i.e. with uniform diameter, to the plane of the exit opening to the ambient atmosphere. Such nozzles are referred to here as "straight" to distinguish them from supersonically contoured nozzles and when choked have only a maximum flow velocity at the nozzle throat of Mach No. 1.0, although upon leaving the exit opening, the air flow is sufficiently pressurized may expand into the atmosphere and hence may reach supersonic velocity in a region adjacent the nozzle exit. The air delivery path for the straight nozzle is identical to that of the contoured nozzles, (i.e. as shown in FIG. 4), the only change being the replacement of an end insert section of the nozzle to give the different shape and/or size. Since a straight nozzle already incoporates a short extension barrel equal to about 5×D, extending downstream of the throat, comparative tests with additional extension barrels were not carried out for straight nozzles, but instead tests were performed with straight nozzles of varying throat area to illustrate the effect of increasing throat area on nozzle performance, which effect would be expected to be substantially the same for both contoured and straight nozzles. The straight nozzles tested included one of 11 mm$^2$ cross-sectional throat area with a throat exit diameter of 0.175" (for direct comparison with the unmodified contoured nozzle of Table I) plus two others with throat cross-sectional areas of 16 and 32 mm$^2$, respectively, corresponding to throat exit diameters of 0.2015" and 0.268". The same feed tube associated with the contoured nozzle test was used here with its free end projecting just past the exit plane of the nozzle and with the weft introduced with a 1" projecting length beyond the feed tube end as before.

The results of the tests of these straight nozzles appear in Table II and have been plotted in FIG. 23, the several sized nozzles being identified by captions.

TABLE II

| Effect of Throat Size Variations with Straight Nozzle | | | | | | | | | |
|---|---|---|---|---|---|---|---|---|---|
| | Air Arrival Time (ms) Throat Area (mm$^2$) | | | Weft Arrival Time (ms) Throat Area (mm$^2$) | | | Head Pressure (psig) Throat Area (mm$^2$) | | |
| Supply Pressure | 11 | 16 | 32 | 11 | 16 | 32 | 11 | 16 | 32 |
| 40 | 36 | 28 | 21 | NA | 64 | 45 | NA | 39 | 39 |
| 50 | 33 | 26 | 19 | 98 | 55 | 39 | 48 | 48 | 45 |
| 60 | 29 | 25 | 18 | 50 | 44 | 35 | 57 | 57 | 50 |
| 70 | 27 | 22 | 17 | 49 | 33 | 31 | 70 | 67 | 60 |
| 80 | 25 | 20 | 16 | 48 | 30 | 26 | 78 | 78 | 70 |
| 90 | 23 | 19 | 15 | 36 | 30 | 25 | 87 | 87 | 76 |
| 100 | 23 | 18 | 14 | 35 | 30 | 24 | 97 | 96 | 87 |
| 110 | 20 | 18 | 13 | 30 | 32 | 21 | 110 | 108 | 99 |
| 120 | 20 | 17 | 12 | 26 | 25 | 20 | 120 | 118 | 108 |

From these results, one concludes that air arrival times as well as weft arrival times are generally improved, i.e., lower, by increasing the cross-sectional area of the nozzle throat. Here again, the efficiency of the 11 mm$^2$ nozzle, similar to the contoured nozzle of Table I, is substantially better at higher than lower operating pressures, and such behavior is seen to some extent for the 16 mm$^2$ nozzle. That is, while all of the tested nozzles exhibit a potential or capacity for highly accelerated weft delivery times, as shown by their air delivery times, that potential may in fact be realized only when their driving pressure has been adjusted to a sufficiently high level since it is at these higher pressures that the weft delivery times exhibit a pattern which begins to track or parallel the pattern of the air arrival times. For this reason, it is preferred in actual practice that the supply pressure for a given weft and nozzle be adjusted as necessary to produce weft arrival times which change as a function of pressure at the same rate as the air arrival times, i.e. that the supply pressure be within the region where the weft and air arrival times are substantially parallel and optimum performance is actually realized.

d. Nozzle Supply Capacity Variations

In all of the tests of Tables I and II above, the pressure source for all nozzles tested included a supplemental supply reservoir or accumulator designated 137 in FIG. 1 having a volume of 80 in$^3$ in addition to the 6 in$^3$ capacity of the nozzle supply chamber itself, this accumulator being connected to the nozzle supply chamber inlet opening through a ⅜" I.D. line of not more than 12" length and in turn connected to a line pressure main having the indicated supply pressure. To illustrate the difference this added supply capacity makes on nozzle performance, oscilloscopically derived head pressure traces were recorded using the contoured nozzle of Table I having the 5×D barrel at a supply pressure of 100 psig with the supplemental reservoir connected and disconnected, respectively, and these head pressure traces are shown side by side in FIGS. 34A and 34B wherein each horizontal unit represents a time interval of 5 or 10 secs. and each vertical unit pressure change of 30 psig. Both traces confirm the almost instantaneous response time of the preferred nozzle design of the invention, that is, the pressure rises from zero to a maximum near in both cases to the 100 psig supply pressure in less than 2 ms, and actually exceeds that pressure very briefly before the pressure wave oscillations stabilize or dampen out after a few more milliseconds. It can be seen, however, that with only the nozzle supply chamber capacity itself available, the head pressure after reaching maximum gradually decreases until at the end of the approximately 15 ms nozzle activation period, the head pressure in the nozzle of the small capacity (6 in$^3$) has dropped to approximately 70–75 psig. In contrast, with the supply capacity augmented to a full 86 in$^3$, as preferred, the pressure trace exhibits a virtual flat plateau maintaining full head pressure over the entire activation interval of the nozzle and drops only after flow of air to the nozzle has been positively terminated.

rapidly to ambient. This behavior indicates that the supply capacity volume, even when only 6 in$^3$, is very substantially in excess of the rate of flow that can pass through the nozzle throat at the given pressure over the pulse interval and that the supply capability of the supply chamber is in fact delivered to the nozzle throat at a rate greater than the nozzle flow rate.

The "fall time" of each pressure trace tends to be somewhat longer than the "rise time" due to the need of residual air in the delivery passages between the nozzle diaphragm valve and throat to dissipate but the bulk of the pressure drop occurs almost instantaneously and the remainder has no perceived effect on nozzle performance. As previously stated, any clamping of the weft must occur only after substantial decay of the trace to avoid disintegration of the weft.

e. Air Pulse Width Variation

The results comparing high and low air supply capacities were, as stated, obtained with an approximate 15 ms nozzle activation interval, as were the results of Tables I and II, and the option exists of altering this interval to change the duration of the air pulse emitted by the nozzle. The effect of such alteration for both large and small capacity nozzles is set forth in Table IV for the 11 mm$^2$ area contoured nozzle of Table I supplied with a pressure of 80 psig.

TABLE IV

| | Effect of Variation in Air Pulse Width | | | | | | | | |
|---|---|---|---|---|---|---|---|---|---|
| | Pulse Width (ms) | | | | | | | | |
| | 5 | 8 | 10 | 15 | 20 | 25 | 30 | 35 | 40 |
| A. Large Capacity | | | | | | | | | |
| Air Arrival (ms) | NA | 28 | 25 | 23 | 23 | 23 | 23 | 23 | 23 |
| Weft Arrival (ms) | NA | NA | 55 | 33 (28) | 28 | 26 | 26 | 26 | 26 |
| Integrated Pressure Units | — | — | — | 1179 | — | — | — | — | — |
| B. Small Capacity | | | | | | | | | |
| Weft Arrival (ms) | — | — | — | 39 | 31 | 29 | 30 | — | — |
| Integrated Pressure Units | — | — | — | 970 | 1102 | 1473 | 1560 | — | — |

Data showing the effect of the difference in air supply capacity on air and weft delivery capabilities of the nozzle is summarized in Table III below from which one learns that the high capacity gives significantly improved efficiency at lower pressures and slight improvement at higher pressures. The data of Table III appears graphically in FIG. 27 (consolidated with curves illustrating the effect of another variable, i.e. the Mach number in contoured nozzles which will be discussed later).

Below the 10 ms level, the nozzle was incapable of projecting the yarn across the full 52" distance at all, as indicated by the letters "NA" (no arrival), but significant improvement was obtained with this nozzle at higher operating pressures, as was true in Table I and FIG. 22. In the test utilizing only a small capacity (6 in$^3$) unit, only weft arrival times were recorded at several pulse width intervals.

Based on this data, for the nozzles in question, the air pulse width or duration should be at least about 10 ms

TABLE III

| | | Effect on Weft Arrival Times (ms) of Variation in Supply Capacity | | | | | | | | | |
|---|---|---|---|---|---|---|---|---|---|---|---|
| | | Supply Pressure | | | | | | | | | |
| Nozzle Type | Mach No. | 30 | 40 | 50 | 60 | 70 | 80 | 90 | 100 | 110 | 120 |
| | | A. Large Capacity (86 in.$^3$) | | | | | | | | | |
| Con No Bbl | 1.5 | 68 | 63 | 59 | 50 | 39 | 35 | 35 | 33 | 28 | 25 |
| | | B. Small Capacity (6 in.$^3$) | | | | | | | | | |
| Con 5 × D Bbl | 1.5 | — | 75 | 75 | 52 | 38 | 32 | 28 | 28 | 28 | 26 |

In the pressure traces for both the small and large capacity nozzles, after completion of the "rise time", the supply pressure remains well above ambient pressure over the entire pulse interval, and a distinct inflexion or break appears in each trace only when the control valve is positively moved to closed position to cut off the air flow, the head pressure then decreasing fairly and preferably within the range of about 15–35 ms at the preferred pressure range of about 60–80 psig, dependent upon air supply capacity and other considerations.

To provide an alternative basis of evaluation, the areas under the pressure traces for the pulse obtained with the small capacity (6 in$^3$) air supply plus one large capacity pulse for comparison were integrated to give a value representing the total quantity of "pressure units" expended during the entire air pulse, and these values are stated in Table IV as "integrated pressure units". The weft arrival time for the large capacity nozzle varied somewhat from an earlier value, the latter being indicated in parentheses. It will be seen from these values that the large supply capacity (86 in$^3$) nozzle can achieve roughly equal arrival times as a small capacity nozzle consuming about 30–40% more pressure energy, as measured in integrated pressure units.

f. Comparative Prior Art Simulation

To afford a basis for evaluating performance of the system of the invention against the performance typically achieved by prior art weft insertion systems, a simulation of a typical prior art system was devised as shown schematically in FIG. 24. To eliminate the influence on performance of nozzle design, the nozzle of the simulation was actually a version of the nozzle of the invention, as depicted in FIG. 4, with the actuating diaphragm removed and the 6 in$^3$ supply capacity volume blocked out with an impermeable filler, e.g. wax, so that air admitted to the end opening of the nozzle fed directly into the annular passage 115 in the nozzle head and thence to the delivery passageway of the nozzle. The nozzle inlet was connected by three feet of an air conduit of ⅜" O.D. and about ¼" I.D. to the outlet of a ¼" cam operated poppet diaphragm valve. The inlet side of this valve was in turn connected by 12" of the same tubing to a pressure regulated capacitor. The poppet valve was actuated by means of an air motor rotated at approximately 400 rpm, the configuration of the cam being such that the poppet valve was displaced to open position for an interval of 55–60 ms.

In order to allow the air motor driven poppet control valve to be brought up to operating speed before delivery of the air thereto, the air supply capacitor actually took the form of one of the nozzles of the invention including the supplemental reservoir (total capacity 86"$^3$), the outlet of the nozzle being connected to the inlet of the poppet valve as stated. In this way, instantaneous delivery of the air to the already working poppet valve could be readily accomplished, the supply nozzle valve being maintained in open position throughout the full operating interval of the poppet valve. The pressure delivered by this supply nozzle was adjusted to provide the desired effective supply pressure to the poppet valve. All other conditions were the same as in the tests of Tables I and II, and air arrival times, weft arrival times, as well as pressure traces, were derived and recorded as before.

The nozzles employed in the prior art simulation were the straight nozzles of Table II, having the same varying areas of 11, 16 and 32 mm$^2$, respectively, without any additional extension barrel. The duration of the air pulse was 55–60 ms. The results of these tests are summarized in Table V below and are plotted graphically in FIGS. 25 and 26 which plot air and weft arrival times versus supply pressure and nozzle head or stagnation pressure, respectively.

TABLE V

Results of Prior Art Simulation with Straight Nozzles of Varying Throat Area

| Supply | Air Arrival Time (ms) Throat Area (mm$^2$) | | | Weft Arrival Time (ms) Throat Area (mm$^2$) | | | Head Pressure (psig) Throat Area (mm$^2$) | | |
|---|---|---|---|---|---|---|---|---|---|
| Pressure | 11 | 16 | 32 | 11 | 16 | 32 | 11 | 16 | 32 |
| 40 | 47 | 46 | 63 | 53 | 53 | 68 | 26 | 20 | 10 |
| 50 | 43 | 40 | 47 | 50 | 50 | 55 | 32 | 27 | 13 |
| 60 | 40 | 37 | 40 | 47 | 42 | 50 | 40 | 31 | 16 |
| 70 | 38 | 35 | 38 | 44 | 40 | 45 | 46 | 36 | 20 |
| 80 | 36 | 33 | 35 | 40 | 40 | 41 | 52 | 42 | 25 |
| 90 | 34 | 31 | 32 | 38 | 38 | 40 | 60 | 49 | 30 |
| 100 | 32 | 30 | 29 | 36 | 36 | 38 | 66 | 54 | 34 |
| 110 | 31 | 29 | 28 | 35 | 35 | 34 | 74 | 60 | 38 |
| 120 | 30 | 28 | 27 | 35 | 34 | 32 | 80+ | 70 | 42 |

From this data, one learns that the air arrival values for the prior art simulation are substantially independent of variations in the throat area (apart from the 32 mm$^2$ area nozzle at pressures below about 50 psig, which gave even worse values) but in all cases are substantially slower than the air arrival times achieved by the invention. Inasmuch as the air arrival time constitutes a limiting factor on performance, in the sense that the weft arrival times can never exceed the air arrival times so that the most one can hope for is to achieve weft arrival times as close as possible but always somewhat less than the air arrival times, it follows that the weft arrival times achieved in the prior art simulation are inherently inferior to those possible with the system of the invention and are never in fact as short as the desired goal of 30 ms, even with a large area nozzle and very high supply pressures. At low supply pressures, the weft arrival times achieved with the small area nozzles in the prior art system may sometimes be shorter than those achieved with comparable nozzles in the system of the invention, but this apparent advantage is more than offset by the greater duration of the pulse interval in the prior art simulation exceeding by four times the pulse interval of the inventive system, with a consequential greatly multiplied consumption of air. Thus, compared on the basis of actual energy consumed, the system of the invention exhibits significantly greater overall efficiency. In addition, the system of the invention has the potential for greatly improved efficiency by increasing supply pressure which is inherently lacking in the systems operated in the manner of the prior art.

The "pressure signatures" recorded for the various tests in the prior art simulation are duplicated in FIGS. 31A-I, 32A-I, and 33A-I for 11 mm$^2$, 16 mm$^2$, and 32 mm$^2$ throat areas respectively, covering at 10 psi intervals the entire supply pressure range of 40–120 psig and comparable "pressure signatures" for the same 11 mm$^2$, 16 mm$^2$, and 32 mm$^2$ area nozzles operated according to the invention in the tests of Table II appear (with scale changes for convenience as indicated) in FIGS. 28A-I, 29A-I, and 30A-I, respectively, at the same pressures. Analysis of these pressure signatures shows that for the invention, the instantaneous achievement of maximum nozzle pressure occurs essentially independently of supply pressure, i.e., is virtually identical throughout the entire pressure range, and is only moderately affected by increases in nozzle throat area. Even for a large throat area nozzle, i.e., 32 mm$^2$, the time for the head pressure to rise from zero to maximum, i.e., "rise time", rarely exceeds 5 ms, in a majority of instances is not more than about 3 ms, and frequently is only 1 ms. Similarly, the "plateau effect" discussed previously, wherein the maximum head pressure persists substantially at full maximum level throughout the entire interval of the pulse, is characteristic of all of the pressure traces representing the inventive system. Even for the maximum throat area nozzle, the loss in pressure from beginning to end of the pulse is in the order of approximately 5% and never goes as high as 10%. The maximum pressure trace levels representing operating head pressures for the invention closely approximate the supply pressure levels. From these relationships, one concludes that the nozzles of the invention are thus delivering pressure energy to the yarn at the highest possible efficiency and are in choked condition.

Furthermore, the portion of the pulse in the invention during which the maximum pressure is at least substantially maintained always substantially exceeds, i.e., by a factor of at least two, the rise time. This means that the pulse is predominantly devoted to useful work with minimum loss in "starting up".

In contrast, the head pressure traces obtained during the prior art simulation exhibit radically different characteristics. In the first place, the "rise time" even for the very small throat area nozzles is in all instances at least, and usually greater than, 20–25 ms and does not become substantially shorter with increasing or decreasing nozzle throat area. That is to say, the slow rise time of the prior art simulation is inherent in the air supply thereof and is not improved by varying the nozzle area. Collaterally with the prolonged rise time, the pressure wave form of the prior art system does not after its initial peak show a temporary oscillation or "hunting" which tends to denote a fully loaded choked condition.

In the second place, even though each nozzle in the prior art simulation maintains maximum head pressure for a significant proportion of the pulse interval and until the poppet valve begins to close upon release of its operating cam, thereby indicating an ample supply capacity of air during the simulation the actual head or stagnation pressure level occurring within each of the nozzles during the prior art simulation is at most in the order of about 60–70% of the supply pressure levels and is significantly less than the percentages achieved in the invention. Moreover, the difference between head and supply pressures increases dramatically with increasing throat area so that for nozzles with the largest throat area, maximum head pressure is in the order of only 25–30% of supply pressure. From these characteristics, one must conclude that the nozzles in the prior art simulation are in no case choked in the sense of the invention, notwithstanding their operation at supply pressures over the same range.

In the simulation pulses, almost as much, and sometimes more, time is consumed in reaching working pressures, i.e. "starting up", as in maintaining working pressure which imposes a definite obstacle to high operating speeds and efficiency.

g. Other Variable Conditions in the Invention (1) Air Velocity

Since the practically equivalent performance of supersonically contoured and straight nozzles in the system of the invention was unexpected, tests were carried out to check this performance by measuring the actual velocities of air pulses at the moment of entry into the inlet opening of the guidance tube at speeds above and below sonic velocity (i.e., Mach 1) and observing the effect of such variation on air arrival times over the 52" fixed test distance, as well as on the velocities of the air flow measured at the tube exit. This was done by adjusting the distance between the nozzle exit plane and the tube entrance plane to achieve supersonic and subsonic air velocities at the guidance tube inlet, as measured by a hot wire anemometer located in the inlet and calibrated as precisely as possible to accurately indicate air velocity, the exit velocities also being measured by hot wire anemometer. The results of these tests are shown in Table VI below and establish that the air arrival times are virtually identical irrespective of whether the initial air velocity was supersonic or subsonic, although the air exit velocities did reflect (but not proportionately) the differece in starting velocities. This performance held true at head pressures of 60, 80 and 104 psig.

TABLE VI

Effect of Varying Air Velocity with Contoured Nozzle

| Head Pressure | Distance Between Nozzle and Tube | Air Velocity (ft/sec) Tube Entrance | Air Velocity (ft/sec) Tube Exit | Air Arrival Time (ms) |
|---|---|---|---|---|
| 60 | 1.125 | 1200 | 225 | 28 |
| | 2.500 | 900 | 200 | 28 |
| 80 | 1.125 | 1300 | 300 | 26 |
| | 2.500 | 900 | 250 | 26 |
| 104 | 2.000 | 1300 | 375 | 22 |
| | 4.250 | 900 | 300 | 23 |

(2) Spacing Between Nozzle and Guidance Tube

As the preceding discussion suggests, an available option is the adjustment of the clearance space or separation between the exit plane of the nozzle and the entrance plane of the guidance tube and a series of tests to establish the effect of nozzle spacing was carried out using a supersonically contoured nozzle having a throat area of 11 $mm^2$ and a Mach number of 1.5 with and without extension barrels of 5 times and 10 times the nozzle exit diameter, respectively, at a supply pressure of 80 psig, a pulse width of 15 ms and a large capacity ($86''^3$) air supply. The air arrival times achieved when this spacing was gradually varied from zero to 6" are summarized in Table VII.

TABLE VII

Effect of Varying Spacing of Nozzle Exit from Guidance Tube Entrance With and Without Extension Barrel

| Spacing in Inches | Air Arrival time (ms) No Barrel | 5 × D Barrel | 10 × D Barrel |
|---|---|---|---|
| 0 | NA | NA | 27 |
| .250 | NA | 25 | 26 |
| .500 | NA | 25 | 26 |
| .750 | NA | 25 | 26 |
| 1.000 | NA | 24 | 26 |
| .250 | 25 | 24 | 26 |
| .500 | 25 | 24 | 27 |
| .750 | 27 | 23 | 24 |
| 2.000 | 27 | 24 | 25 |
| .250 | 28 | 23 | 24 |
| .500 | 28 | 24 | 24 |
| .750 | 29 | 24 | 25 |
| 3.000 | 30 | 23 | 24 |
| .250 | 32 | 24 | 25 |
| .500 | 32 | 25 | 27 |
| .750 | 35 | 25 | 27 |
| 4.000 | 37 | 26 | 27 |
| .250 | 37 | 27 | 28 |
| .500 | 39 | 28 | 27 |
| .750 | 40 | 28 | 29 |
| 5.000 | 45 | 29 | 30 |
| .250 | 46 | 30 | 31 |
| .500 | 55 | 31 | 32 |

TABLE VII-continued

| Effect of Varying Spacing of Nozzle Exit from Guidance Tube Entrance With and Without Extension Barrel | | | |
|---|---|---|---|
| | Air Arrival time (ms) | | |
| Spacing in Inches | No Barrel | 5 × D Barrel | 10 × D Barrel |
| .750 | 58 | 32 | 34 |
| 6.000 | 65 | 34 | 35 |

From these results, it follows that no real optimum location for the nozzle appears to exist and variation in nozzle position within reasonable limit has no significant effect on the air arrival times. Thus, between approximately an inch or less up to approximately 3–4", satisfactory air arrival times are produced and can be improved even further by the addition of a short extension barrel to the nozzle. Beyond about 4" separation, the air arrival times begin to suffer even with the addition of the extension barrels.

(3) Nozzle Mach No.

Another factor susceptible to change in the practice of this invention is the Mach number of the supersonically contoured nozzle and to explore the influence of this variable on weft delivery efficiency, a series of tests was performed using supersonically contoured nozzles having an identical throat area of 11 $mm^2$ with increasing exit opening diameters (i.e. 0.186", 0.207" and 0.220") as necessary to provide design Mach numbers of 1.5, 1.91 and 2.07, respectively. These nozzles were tested for weft arrival times only both with and without a 5×D barrel at supply pressures in the range of 30–120 psig, and the data produced in the tests are summarized in Table VIII and are plotted in FIG. 27. From this data one sees the change in Mach number has little or no practical influence on the effectiveness of the nozzle in propelling the weft, although the addition of a barrel does afford some improvement at lower supply pressures.

TABLE VIII

| Effect on Weft Arrival Times (ms) of Variation in Contoured Nozzle Mach Number | | | | | | | | | | | |
|---|---|---|---|---|---|---|---|---|---|---|---|
| | | Weft Arrival Time (ms) Supply Pressure | | | | | | | | | |
| Nozzle Type | Mach No | 30 | 40 | 50 | 60 | 70 | 80 | 90 | 100 | 110 | 120 |
| Con No Bbl | 1.5 | 68 | 63 | 59 | 50 | 39 | 35 | 35 | 33 | 28 | 25 |
| Con No Bbl | 1.91 | NA | 70 | 62 | 54 | 36 | 35 | 33 | 31 | 31 | 27 |
| Con No Bbl | 2.09 | NA | NA | 72 | 45 | 40 | 34 | 33 | 31 | 29 | 29 |
| Con 5 × D Bbl | 1.5 | 68 | 58 | 39 | 33 | 30 | 30 | 30 | 28 | 26 | 24 |
| Con 5 × D Bbl | 1.91 | NA | NA | 53 | 41 | 30 | 25 | 26 | 26 | 24 | 21 |
| Con 5 × D Bbl | 2.09 | NA | 64 | 43 | 35 | 33 | 33 | 29 | 24 | 23 | 21 |

All of the tests in Table VIII included the large (86"$^3$) supply capacity for the various nozzles, and it will be recalled that FIG. 27 includes a curve representing a test of a Mach 1.5 nozzle with a 5×D barrel identical to the corresponding nozzle of Table VIII, but having a small capacity (6"$^3$) air supply. Comparing these results, one sees the considerable extent of improvement afforded by the addition of the large capacity supply which is particularly prominent at lower pressures, i.e. below about 90 psig.

(4) Projected Energy Consumption

The importance of a capability for effective operation at the lower range of supply pressures which characterizes the invention is illustrated by the following Table IX which shows a projected consumption of energy, expressed in kilowatts per minute, for a loom equipped with the system of the invention and operating at 1000 picks per minute for nozzles having throat areas of 11 $mm^2$ and 16 $mm^2$, either supersonically contoured or straight, with a pulse duration of 15 ms and a large (86"$^3$) capacity supply.

TABLE IX

| Projected Energy Consumption (kilowatts) | | | | | | | | | |
|---|---|---|---|---|---|---|---|---|---|
| | Supply Pressure (psig) | | | | | | | | |
| | 40 | 50 | 60 | 70 | 80 | 90 | 100 | 110 | 120 |
| 11 $mm^2$ Nozzle Area | .323 | .447 | .579 | .721 | .873 | 1.03 | 1.203 | 1.378 | 1.56 |
| 16 $mm^2$ Nozzle Area | .473 | .649 | .839 | 1.04 | 1.26 | 1.50 | 1.73 | 1.99 | 2.26 |

Thus, the increase in power consumption is not a linear function of either increasing head pressure or nozzle throat area but an exponential function, the energy consumption at 90 psi supply pressure, for example, being more than three times the consumption at 40 psi.

h. "Balanced Mode" of Operation

In the preceding discussion of the operation of the system of the invention, it is suggested that the selection of (a) a relatively high level of head pressure is advantageous in achieving particularly fast air arrival times, which gave the capability of minimum weft arrival times and offered maximum potential for high operating speeds with (b) a minimum effective duration for the air pulse, i.e. about 15–20 ms, in order to reduce energy consumption as much as possible. When operating in this manner, observation has shown that during flight, the leading end section of the weft tends to become bunched upon itself as it encounters the resistance of the stationary column of air within the guidance tube, and it was reasoned that this problem was aggravated by the fact that the metered and stored length of weft had been withdrawn from the weft storage drum section within a period of time significantly less than the time required for that weft end to actually traverse the width of the loom.

Usually, as the projected weft length completes its traverse, the bunched-up leading section will eventually straighten out and arrive at the reception side of the warp shed but, occasionally, say one to two times per 1000 or so picks of operation, the bunched-up leading section apparently becomes sufficiently tangled as to resist straightening out under the fairly light inertial forces working upon it. When this condition develops, the leading end of the weft does not actually reach the far side of the shed for engagement by the reception tube there, and if the weaving is continued, the result is the introduction of a defect in the fabric being woven. As described, the system of the invention preferably includes a weft arrival detection unit which serves to detect the failure of the weft end to arrive at the reception nozzle and halt the weaving operation automatically to allow for the intervention of a human operator to correct the fabric defect, but this results in loss of production due to the "down time" needed to correct the defect.

Furthermore, the air pulse injected by the nozzle into the guidance tube actually moves through the guidance tube as a kind of column corresponding in length to the duration of the pulse. Thus, the "air travel" times emphasized in preceding description represent arrival of only the leading end of the column and air continues to advance through the tube until the trailing end of this column passes out the tube. If the weft traveling through the guidance tube slows down or stops while the trailing end of the air column is still advancing rapidly, it has been found that the free weft end can be blown "off course" and out of the guidance tube egress slot 49 instead of continuing through the tube bore. Indeed if the air column is still at full speed after the weft has been entirely withdrawn and its free end held in the reception tube, a "backlash" can occur, pulling the free weft end out of the reception tube and blowing it out of tube egress slot 49. Once the weft free end has escaped through slot 49, a weaving defect, i.e. "mispick" is inevitable.

The bunching and tangling phenomenon has been found upon inspection to always occur on the leading end section, i.e. the last 2–3", of the weft length and one possible solution to this occasional problem would be the addition of enough extra length to the weft that it will reach the reception side of the warp even when the bunching phenomenon occurs. Obviously, however, with the addition of this added length during every cycle (it being impossible to predict in advance a particular cycle during which the phenomenon might occur) the amount of waste produced during weaving is correspondingly increased. Consequently, this solution violates an important objective of the invention of maximizing efficiency and minimizing waste.

It has been discovered that the bunching phenomenon can be better avoided by adjusting the weft insertion thrust and/or resistance so as to arrive at a mode of operation which is more "balanced" in the sense of matching the time required to completely withdraw the stored weft length from the storage section with the time required to completely project the end of that weft length across the full width of the shed. Reduction of the nozzle head pressure, of course, results in a reduction in the thrust imparted to the weft, other conditions being equal, and there can be definite practical advantages in selecting a nozzle head pressure of about 60–70 psig. Most textile mills currently in operation already have available for normal mill functions compressed air at a pressure of about 75–80 psig, which is fully adequate to achieve head pressures of the desired 60 psig or so level, and there are obvious practical advantages in being able to utilize the existing mill compressed air supply. Otherwise, expensive special compressing equipment would have to be purchased and installed to produce the required higher pressure level which would greatly add to the cost of putting the present invention into actual practice.

When operating at a head pressure of about 60 psig as just indicated, the thrust imparted to the yarn is still somewhat excess from the standpoint of achieving the balanced mode of operation described above and additional measures need to be applied.

Several ways are available for balancing weft withdrawal time with weft projection time. On the one hand, the efficiency of the nozzle in transmitting its pressure forces to the weft end can be reduced as, for example, by extending the distance between the end of the yarn feed tube and the exit plane of the nozzle, say increasing the projecting length of feed tube to about $\frac{3}{8}$" instead of about $\frac{1}{8}$" as before, and this is presently the preferred technique. Alternatively, the resistance or "drag" of the weft length during its withdrawal from the weft storage unit can be increased either by increasing the distance between the balloon guide and the end of the delivery drum so as to lengthen the unwinding balloon and increase its diameter or by adding tension to the weft upstream of the inlet of the nozzle.

The effect of the balanced mode of operation is to "stretch" the energy forces applied to the weft over a longer period of time with the result that the withdrawal of the stored weft length does not take place as rapidly as before but instead occurs at a rate substantially matching the rate at which the weft is advancing through the warp shed. Therefore, overrunning of the leading end by the on-coming weft length is virtually eliminated with consequential disappearance of the bunching phenomenon.

Optimum performance is obtained where the free weft end exits from the end of the guidance tube before the stored coils of weft have been completely withdrawn from the drum storage section; that is, the weft end leaves the guidance tube before an initial tension rise is detected by the tension detector 338. Ideally, the arrival of the weft end within the reception tube, as signaled by the photoelectric detection means, occurs virtually simultaneously with the departure of the last of the stored weft from the drum storage unit; that is, the detected tension rise and weft arrival signal are virtually coincident.

Operation with head pressures consistent with available mill line pressures has a further practical advantage, namely, a considerable reduction in the time required for the pulse to decay from its plateau level back to zero. In the "balanced mode" operation, the pulse decay can be reduced to about 7 ms from about 12 ms as typically characterizes the "high impulse" mode. This makes possible the prolongation of the plateau phase of the pressure pulse without concomitant risk of continuation of the pulse after the weft has in fact arrived at the reception side of the shed. Mention has already been made of the fact that if the pulse persists after the weft is in fully straightened static condition, the weft will be buffeted about severely leading to its degradation if not complete disintegration. In the balanced mode the pressure pulse can be "stopped" so to speak, in roughly half the time required for the higher pressures; it thus is easier to insure that the pulse has ended before the weft has achieved a stationary condition within the shed. In general, it is preferred that the pulse be completely decayed about 2–3 ms prior to the arrival of the leading weft end at the reception side of the loom.

It has been discovered that the sacrifice in weft arrival times obtined in accordance with the balanced mode of operation is at most small. For instance, with a head pressure of 60 psig, a pulse duration extended to about 30 ms, and the preferred weft feed tube projection of $\frac{3}{8}$", air arrival times equal to about 23 ms and weft arrival times of about 32 ms can be consistently attained with ease.

i. Other Conventional Factors

There exists in the operation of the system invention factors other than those described above which are not peculiar to the invention but are shared with prior art systems, so that full description of the role they play is not necessary here. One such factor is the nature of the stand itself and in common with prior art air weft insertion systems, the system of the invention works effectively principally only with relatively rough surfaced wefts. Such wefts are represented by conventional twisted spun staple yarns, either natural or synthetic, and presumably by textured surface synthetic filaments as well. Smooth surfaced mono-filaments have not been examined so far.

The influence of the size of the weft has not been examined thoroughly but the capacity of the various nozzles described above is sufficient to readily accommodate considerable range of conventional deniers and no difficulty is anticipated in the utilization of the inventive system with such yarns, given the potential for supply pressure variation inherent in the present system. Wefts tested to date range from 12's–50's cotton staple yarns, and all have been satisfactorily woven without change in operating conditions.

A further factor is the diameter of the weft guidance tube. Rough bench tests have established that a certain minimum tube diameter is needed for the weft to be effectively transported through the entire tube length. For example, with the various nozzles mentioned above, an inner bore for the tube of ½" is not adequate; only the large throat area nozzles (32 mm$^2$) are capable of delivering the strand entirely through a ½" I.D. guidance tube and even with these nozzles, the weft arrival times are quite long, e.g. in the order of 60 ms. On the other hand, tube bore diameters of ¾" are entirely satisfactory and all of the numerous tests appearing above were carried out with a tube of this dimension, as stated. The bore diameter could likely be increased further without drastic consequences on operational effectiveness, but no particular advantage is seen in doing so. A reasonable theory is that if the tube bore diameter is too small in relation to the nozzle outlet diameter, the tube tends to unduly confine the air pulse column emitted by the insertion nozzle, in the sense of frictionally resisting its passage and/or interfering with its freedom to undergo some expansion upon emergence from the nozzle opening. However, so long as the nozzle diameter is sufficiently large to afford the air pulse a minimum dynamic freedom, satisfactory operation is possible and larger diameter tubes would, of course, afford greater freedom. On the other hand, the guidance tube is a critically important part of the system and if omitted, the weft projection capacility of the nozzle is extremely limited and far less than the width of any normal sized loom. The applicants suspect that a similar relationship exists between prior art nozzles and tube diameter, although no express recognition of this fact has as yet appeared in the published art to applicants' knowledge.

It follows from the preceding comment that the present system is designed for association with "normal-sized" looms, i.e. about 48" in width or greater. Special narrow width looms are known, e.g. ribbon looms, sword looms and the like, but high speed operation of such looms is possible in other ways, i.e. by means of mechanical transports, e.g. swords, because of their much less demanding technological requirements, and little reason exists for resorting in such narrow looms to the more sophisticated approach of the present system.

Further with regard to the guidance tube, mention has already been made of the practice in the invention of mechanically abrading the interior surface of the guidance tube bore to impart a reasonable degree of polish or smoothness thereto, as by means of honing. Air and weft arrival times may be reduced significantly more with internally polished tubes as compared to tubes with surfaces obtained by conventional casting or molding. However, for the balanced mode of operation honing has not been necessary and careful assembly of the elements by means of a jig produces satisfactory registration.

The axial thickness and frequency of the segments making up the guidance tube is generally determined by the requirement that the elements making up the tube be sufficiently close together as to effectively confine the air flow, which can limit the size and number of the warp threads, but this limitation applies to any system utilizing a guidance tube. Segments having an axial dimension of about ⅛" and spaced apart about 20/1000–35/1000 have performed well.

j. Specific Example

A shuttle loom of 48" width converted according to the present invention is used to weave print cloth from 40's warp threads spun from a 35/65 mixture of cotton and polyester staple fibers and 35's weft threads spun from the same 35/65 mixture of cotton and polyester staple. The total number of warp threads is 3750 and the reeded width of the warp is 51.5". The loom is equipped with the nozzle of FIG. 5 including the large capacity accumulator and the control unit is the modified mechanical embodiment of FIGS. 11–13. The nozzle is a supersonically contoured nozzle having a throat area of 11 mm$^2$, a Mach number of 1.5 and 5×D extension barrel giving a head pressure of 70 psig. The end of the weft feed tube projects ⅜" beyond the end plane of the barrel in contrast to the feed tube arrangement in the various tests in the preceding description where the feed tube terminated in all cases at the exit plane of the nozzle orifice exclusive of any extension, i.e. the plane designated 88 in FIG. 4. The loom is operated at 318 picks per minute.

A representative cycle of operation of the above loom is depicted in the strip chart of FIG. 35 which shows in timed relationship the following wave forms: a the activation, i.e. opening and closing of the weft delivery clamp C, 330; b the head or stagnation pressure of the insertion nozzle; c the weft delivery tension as detected by the tension detector 338; and d the arrival of the weft at the reception tube, as detected by the photoelectrc array. The clamp opens at 140°, remains open for a period of 40 ms and closes at 217°. The insertion nozzle is activated at 145° for a period of 34 ms, the head pressure subsiding to starting level at about 220°.

With the activation of the nozzle, the tension in the weft increases from its "previous noise level" almost coincidentally with the nozzle activation and perceptible peak in weft tension occurs at 208° indicating the complete withdrawal of the weft from the drum storage section, the weft tension indicator thereafter subsiding to its inherent "background" level. The arrival of the weft end at the photodetector occurs at 208°, the subsequent peaks e in wave form d being caused by fluttering of the weft end in the reception tube and of no significance. The weft arrival time is 36 ms and the air arrival time (derived by other means) was observed to be 28 ms.

In this description, the abbreviations ms represents milliseconds and psig represents pounds per square inch gauge.

What is claimed is:

1. A method of furnishing strand to user means having demand for finite length of strand comprising the steps of:

(a) continuously advancing said strand from a supply source to a first surface and winding the same thereon, (b) continuously advancing said strand from said first surface toward and onto one end of a second surface for rewinding of the strand on the second surface, (c) periodically operating said user means to withdraw the strand from an opposite end of said second surface while continuing advance of said strand to said first surface and from said first surface toward said one end of said second surface, and (d) halting withdrawal of the strand when a finite length has been withdrawn from said opposite end of said second surface by said user means.

2. A method as set forth in claim 1 wherein said first surface is a surface of rotation .

3. A method as set forth in claim 2 including the step of winding said strand of said first surface in a plurality of spaced apart turns.

4. A method as set forth in claim 2 wherein said strand is continuously advanced in steps (a) and (b) at a generally constant rate and including the step of precluding advance of said strand from first surface to said second surface at a rate faster than said constant rate.

5. A method as set forth in claim 2 including the step of positively engaging at least one of said turns of said strand against said surface of rotation.

6. A method as set forth in claim 2 wherein said strand is re-wound on said second surface in turns and including the step of guiding said strand during its advance from said first surface to said one end of said second surface along an inclined surface to arrange said turns on said second surface in predetermined sequence.

7. The method as set forth in claim 6 wherein said inclined surface is disposed adjacent said one end of said second surface and is inclined downwardly and forwardly toward said end.

8. The method as set forth in claim 7 wherein said second surface is formed as a rotating surface of revolution and said inclined surface is also formed as a surface of revolution rotating with said second surface.

9. the method as set forth in claim 8 wherein said inclined surface is integral with said one end of said second surface.

10. A method as set forth in claim 1 wherein said first surface is stationary while the strand is wound thereon.

11. The method as set forth in claim 10 including the step of guiding said strand around said surface to wind a plurality of turns of strand thereon before said strand is advanced to said second surface.

12. A method as set forth in claim 11 including the step of arranging said plurality of turns of strand on said first surface in positions spaced from each other.

13. A method as set forth in claim 10 including the step of precluding the withdrawal of said strand by said user means from causing said strand to advance from said first surface to said second surface.

14. A method as set forth in claim 1 creating the step of inducing a current of fluid flow proximate to said second surface to assist winding of said strand on said second surface.

15. A method as set forth in claim 14 including the steps of rotating said second surface and creating said fluid flow current in the direction of rotation of said second surface.

16. A method as set forth in claim 10 wherein said second surface is stationary about an axis, and including the step of guiding the strand around said surface to wind said strand thereon in a plurality of wraps around said axis.

17. A method as set forth in claim 16 including the step of creating a current of fluid flow in a direction urging the wraps into engagement with said surface.

18. A method as set forth in claim 16 including the step of positively forwarding the wraps of yarn bodily in the direction of the axis of said second surface and toward said user means.

19. A method as set forth in claim 1 including the step of advancing said strand to said second surface in a timed relationship to the withdrawal of said strand from said second surface by said user means.

20. A method as set forth in claim 1 including the step of halting withdrawal of the strand by said user means by positively engaging the strand at a locus intermediate said second surface and said user means.

21. Apparatus for furnishing strand to user means having a demand for a finite length of strand comprising (a) a first surface, (b) means for continuously advancing said strand from a supply source to a first surface and winding the same thereon, (c) a second surface, (d) means for continuously advancing said strand from said first surface onto one end of a second surface and rewinding the strand on the second surface, (e) means periodically operating said user means to withdraw the strand from an opposite end of said second surface while continuing advance of said strand to said first surface and from said first surface onto said one end of said second surface, and (f) means for halting withdrawal of the strand when a finite length has been withdrawn from said opposite end of said second surface by said user means without interrupting the advance of the strand onto said first and said second surfaces.

22. Apparatus as set forth in claim 21 wherein said first surface is a surface of rotation.

23. Apparatus as set forth in claim 22 including means for winding said strand on said first surface in a plurality of spaced apart turns.

24. Apparatus as set forth in claim 22 wherein said strand is continuously advanced from said supply to said first surface and from said first surface onto said one end of said second surface at a generally constant rate, and including means for precluding advance of said strand from said first surface to said second surface at a rate faster than said constant rate.

25. Apparatus as set forth in claim 22 including means for positively engaging at least one of said turns of said strand against said surface of rotation.

26. Apparatus as set forth in claim 22 wherein said strand is wound on said second surface in turns and including an inclined surface for guiding said strand during its advance from said first surface to said one end of said second surface to arrange said turns on said second surface in predetermined sequence.

27. The apparatus of claim 26 wherein said inclined surface is disposed adjacent said one end of said second surface and is inclined downwardly and forwardly toward said end.

28. The apparatus of claim 27 wherein said second surface is formed as a rotating surface of revolution and said inclined surface is also formed as a surface of revolution rotating with said second surface.

29. The apparatus of claim 28 wherein said inclined surface is integral with said one end of said second surface.

30. Apparatus as set forth in claim 21 wherein said first surface is stationary.

31. Apparatus as set forth in claim 30 including means for guiding said strand around said stationary surface to wind a plurality of turns of strand thereon.

32. Apparatus as set forth in claim 30 wherein said guide means arranges said plurality of turns of strand on said first surface in spaced apart relation.

33. Apparatus as set forth in claim 30 including means precluding the withdrawal of said strand by said user means from causing said strand to advance from said first surface onto said second surface.

34. Apparatus as set forth in claim 21 including means for creating a current of fluid flow proximate to said second surface to assist winding of said strand on said second surface.

35. Apparatus as set forth in claim 34 wherein said second surface is a rotatable surface of revolution and including means for rotating said second surface, said fluid flow current creating means creates said current in the direction of rotation of said second surface.

36. Apparatus as set forth in claim 30 wherein said second surface is stationary, and including means for guiding the strand around said second surface to wind said strand thereon in a plurality of wraps.

37. Apparatus as set forth in claim 36 including means for inducing a current of fluid flow in a direction urging the wraps into engagement with said second surface.

38. Apparatus as set forth in claim 36 wherein said second surface has an axis about which the wraps are wound including means for positively displacing the wraps of yarn bodily in the direction of said second surface axis and toward said user means.

39. Apparatus as set forth in claim 21 wherein said means for advancing the said strand to said first and second surface is effective to advance the same in timed relationship to the consumption of said strand by said user means.

40. Apparatus as set forth in claim 21 wherein said means for halting withdrawal of the strand by said user means is disposed at a locus intermediate said second surface and said user means.

41. A method of weaving wherein a weft injection nozzle is provided adjacent one side of a warp shed having a length of at least about 48 inches and a weft guidance tube is disposed within said shed for substantial alignment with said nozzle during weft injection, comprising the steps of: during each weaving cycle, metering from a weft supply source for delivery to the bore of the injection nozzle a length of weft substantially corresponding to the length of weft to be inserted in the warp shed in a cycle, delivering a pulse of pressurized air to the bore of the injection nozzle in contact with said weft length to impart to the strand thrusting force from the air stream to thereby project the metered out length of yarn into the warp shed, said pulse containing sufficient thrusting energy to propel the pulse and one end of the weft length across the shed through said guidance tube to the opposite shed side with the leading pulse edge arriving at said opposite shed side prior to the arrival of the leading weft end, and controlling the duration of said pulse to terminate the same at the nozzle before the arrival of the leading pulse edge at the opposite shed side.

42. The method of claim 41 wherein said weft length is withdrawn from said supply source and collected into coils progressively advancing toward the injection nozzle and during the terminal portion of the cycle the weft is withdrawn from such coils by the nozzle at a rate substantially greater than the rate at which the weft length is withdrawn from the supply source during metering.

43. The method of claim 42 wherein said coils are arranged on an axis parallel to the nozzle axis.

44. The method of claim 42 wherein the weft being continuously withdrawn from said source is frictionally engaged at a point upstream of the collected coils and thereby precluded against forced advance in a direction axially of the coils whereby the withdrawal of the weft by the injection nozzle stretches the weft essentially straight from the point of frictional engagement forward into the warp shed.

45. In a cyclical method of weaving wherein a weft injection nozzle is provided adjacent one side of a warp shed having a length of at least about 48 inches to project a weft yarn therefrom across said shed and a weft guidance tube is disposed during weft injection within said shed in substantial alignment with said nozzle, the steps comprising: during each weaving cycle continuously withdrawing from a weft supply source a metered length of weft yarn substantially equal to the length of said shed and delivering said metered weft length to a temporary storage zone for collection therein; in a portion of said cycle delivering a stream of pressurized air in pulse form to the injection nozzle in contact with the weft yarn in said nozzle to deliver an air pulse across said shed, said air stream being capable of imparting to the weft yarn thrusting force at least sufficient to withdraw a metered out length of weft in its entirety from said storage zone and project the leading end thereof across to the oppsite side of said shed; and independently adjusting the magnitude of said imparted thrusting force and the resistance acting on the weft length upstream of said nozzle in relation to the velocity of the leading edge of said pulse so that the length of weft yarn projected by said nozzle does not exceed the distance of travel of the leading edge of said air pulse from said nozzle at any given instant during the entirety of the latter's travel across said shed.

46. The method of claim 45 wherein said weft length is removed from said storage zone during a terminal portion of the loom operating cycle and said weft length is withdrawn and delivered to said temporary storage zone at a rate such that the last of the length reaches said temporary storage zone at substantially the conclusion of said terminal cycle portion, said delivery to said storage zone continuing during the terminal portion of the cycle within which the weft length is being removed by said nozzle, said removal being at a substantially greater rate than said delivery rate to achieve an essentially instantaneous condition of exhaustion of said length from said storage zone notwithstanding the continuous delivery thereto, and upon the achievement of said instantaneously exhausted condition, terminating said removal and instituting said storage of the next weft length for the next weaving cycle.

47. The method of claim 46 including means arranged between said temporary storage zone and said warp shed for clamping the weft length and actuating means for said clamping means to open the same substantially at the beginning of said terminal portion of said cycle and close the same substantially after said stored weft length has been removed from said storage zone.

48. The method of claim 45 wherein the delivery of said stream of pressurized air to the nozzle is terminated prior to the arrival of the leading edge of said pulse at said opposite shed side.

49. The method of claim 45 wherein upon the removal of the entirety of said metered weft length from said storage zone, said yarn is mechanically engaged adjacent said storage zone to prevent said air stream thrust from withdrawing additional yarn directly from said yarn source, and wherein said extent of said imparted thrusting force is further adjusted so that said weft leading end arrives at the opposite shed side substantially coincidentally with said mechanical engagement of the yarn.

50. In a method of weaving wherein a weft injection nozzle is provided adjacent one side of a warp shed for projection of a weft yarn across said shed, the steps comprising: during each weaving cycle continuously withdrawing from a weft supply source a metered length of weft yarn substantially equal to the length of said shed and delivering said metered weft yarn length to a temporary storage zone for collection therein; in a portion of said cycle delivering a stream of pressurized air in pulse form to the injection nozzle in contact with weft yarn to deliver an air pulse across said shed, said air stream being capable of imparting to the weft yarn thrusting force at least sufficient to withdraw a metered out length of weft in its entirety from said storage zone and project the leading end thereof across to the opposite side of said shed; upon the removal of the entirety of said metered weft yarn length from said storage zone mechanically engaging said yarn adjacent said storage zone to prevent said yarn stream thrust from withdrawing additional weft yarn from said yarn source; and independently adjusting the magnitude of said imparted thrusting force and the resistance acting on the weft length upstream of said nozzle in relation to the velocity of the leading edge of said air pulse in moving across said shed so that said weft leading end arrives at said opposite shed side substantially coincidentally with said mechanical engagement of the yarn to prevent direct withdrawal thereof from said yarn source.

51. In a loom including a weft injection nozzle adjacent one side of a warp shed having a length of at least about 48 inches and a weft guidance tube disposed within said shed during weft injection in substantial alignment with said nozzle, the improvement comprising: means operative during each weaving cycle for metering from a weft supply source for delivery to the injection nozzle a length of weft substantially corresponding to the length of weft to be inserted in the warp shed in that cycle, means for expelling a pulse of pressurized air from the injection nozzle to thereby project the metered out length of weft into the warp shed, means for imparting to said pulse sufficient thrusting energy to propel said pulse and deliver one end of the weft length across said shed to the opposite side thereof with the leading pulse edge arriving at said opposite shed side before the leading weft end, and means for controlling the duration of said pulse to terminate the same not later than substantially the arrival of said leading pulse edge at said opposite shed side.

52. The loom of claim 51 wherein said metering means comprises means for continuously and positively withdrawing said weft length from said supply source and collecting the same into coils progressively advancing toward the injection nozzle.

53. The loom of claim 52 wherein said coil collecting means are arranged on an axis parallel to the nozzle axis.

54. The loom of claim 52 including means for frictionally engaging said weft at a point upstream of such coils against forced advance axially of the coils whereby the withdrawal of the weft by the injection nozzle withdraws the entirety of such coils downstream of said point, stretching the weft essentially straight from the point of such frictional engagement forward into the warp shed.

55. In a loom including a weft injection nozzle adjacent one side of a warp shed having a length of at least about 48 inches to project a weft yarn therefrom across the shed, and a weft guidance tube disposed during weft insertion within said shed in substantial alignment with said nozzle, the improvement comprising: means operative during each weaving cycle to continuously withdraw from a weft supply source a metered length of weft substantially equal to said shed length and for continuously delivering said metered weft length to a temporary storage zone for collection therein; means operative during a portion of said cycle to deliver a stream of pressurized air in pulse form to the injection nozzle in contact with the weft yarn in said nozzle to deliver an air pulse across said shed, said air stream being capable of imparting to said weft yarn sufficient thrusting force to withdraw the metered out length of weft in its entirety from said storage zone and project the leading end thereof across said shed to the opposite side; and means for independently adjusting the magnitude of said imparted thrusting force and the resistance acting on the yarn upstream of said nozzle in relation to the velocity of said air pulse so that the length of weft yarn projected by said nozzle does not exceed the distance of travel of the leading edge of said air pulse from said nozzle at any given instant during the entirety of the latter's travel across said shed.

56. The loom of claim 55 comprising clamping means arranged between said temporary storage zone and said warp shed for clamping the weft length and actuating means for said clamping means to open the same substantially at the beginning of said terminal portion of said cycle and close the same substantially when said stored weft length is completely removed from said storage zone.

57. The loom of claim 55 including means for terminating the delivery of said stream of pressurized air to the nozzle prior to the arrival of the leading edge of said pulse at said opposite shed side.

58. A strand delivery system for a weaving loom including a warp shed, a weft injection nozzle disposed adjacent one side of said shed, and means for delivering weft yarn continuously from a yarn supply source to said nozzle for propulsion of the leading yarn end by the nozzle into said shed, said injection nozzle being mounted for bodily cyclical movement to and fro relative to said yarn source during the weaving operation whereby slack develops in said yarn between said nozzle and said supply source during a portion of the cycle, said delivery system comprising means for guiding the strand along a generally predetermined path between said supply source and said nozzle, a generally cylindrical strand receiving surface arranged between said source and nozzle proximate to said strand path with the surface axis extending generally in the direction of at least a portion of that path, and means for creating a generally circular flow of air coaxially with and peripherally around said cylindrical strand receiving surface and said strand path portion, whereby upon the formation of said slack in said strand along said path portion, the slack length of said strand is caused by said air flow to wind upon said cylindrical surface to maintain said slack under control.

59. The strand delivery system of claim 58 including means for winding at least about one turn of said strand upon said cylindrical surface upstream of said circular air flow.

60. The strand delivery system of claim 58 wherein said cylindrical surface is stationary.

61. A strand delivery system comprising a generally cylindrical strand receiving surface supported on an axis, yarn delivery means for delivering to said surface in axially coiled relation thereon a continuous length of a strand from a strand supply source, and means for periodically withdrawing a predetermined length of said strand from said coils over one end of said surface in a direction generally axially thereof, an annular air ring encircling said cylindrical strand receiving surface, said air ring having an inside diameter exceeding the surface diameter to create a clearance space therebetween for passage of said strand therethrough, said air ring including an interior annular manifold supplied with air at an above atmospheric pressure and having an inner wall defining the inner limits of said air ring, said inner wall being perforated by an annular array of radially spaced apart slots communicating between said manifold and the ambient atmosphere, said slots in said array being generally uniformly inclined from a direction radial of the receiving surface axis, whereby pressurized air from said manifold is delivered through said slots in a generally vortical flow within the clearance space between said air ring and said receiving surface, said array of inclined slots being disposed in axially spaced relation to the end of said cylindrical receiving surface over which said strand is periodically withdrawn from the coils thereon, whereby said vortical air flow is effective to cause to wind upon said cylindrical receiving surface any length of slack developing in the strand in the region downstream from said coils.

62. The method of claim 45 wherein said nozzle includes a throat through which said weft yarn passes and including the step of varying the interval downstream of said throat within which said pulse is substantially confined against lateral expansion to thereby vary the thrusting force imparted to said weft yarn.

63. The method of claim 45 wherein said nozzle includes a throat through which said weft yarn passes and said weft yarn is shielded against contact with air passing through said nozzle up to said throat and including the step of varying the distance said weft yarn is shielded fom said nozzle air downstream from said throat and thereby vary the thrust applied to said yarn.

64. The method of claim 45 including the step of varying at a point upstream of said nozzle the resistance acting on the weft yarn to change its impedance to passage through said nozzle by said applied thrusting forces.

65. The method of claim 50 wherein said nozzle includes a throat through which said weft yarn passes and including the step of varying the interval downstream of said throat within which said pulse is substantially confined against lateral expansion to thereby vary the thrusting force imparted to said weft yarn.

66. The method of claim 50 wherein said nozzle includes a throat through which said weft yarn passes and said weft yarn is shielded against contact with air passing through said nozzle up to said throat and including the step of varying the distance said weft yarn is shielded from said nozzle air downstream from said throat and thereby vary the thrust applied to said yarn.

67. The method of claim 50 including the step of varying at a point upstream of said nozzle the resistance acting on the weft yarn to change its impedance to passage through said nozzle by said applied thrusting forces.

68. The loom of claim 55 wherein said nozzle has a throat of minimum cross-section and a normal exit opening therein and including a cylindrical barrel of predetermined length adapted to be mounted to said nozzle downstream of said exit opening to effectively extend the length of said nozzle.

69. The loom of claim 55 including a throat and a hollow yarn feed tube passing through the nozzle from its upstream end to at least said throat with the weft end advancing through the interior of said feed tube, the position of the end of said feed tube relative to said throat being determined according to the extent of thrust to be imparted to the weft yarn by the nozzle.

70. The loom of claim 55 including means for applying a variable resistance to said weft strand upstream of said nozzle to offset in part the thrusting force applied to the weft yarn by the nozzle.

71. In a loom including a weft injection nozzle adjacent one side of a warp shed having a length of at least about 48 inches to project a weft yarn therefrom across the shed, and a weft guidance tube disposed during weft insertion within said shed in substantial alignment with said nozzle, the improvement comprising: means operative during each weaving cycle to continuously withdraw from a weft supply source a metered length of weft substantially equal to said shed length and for continuously delivering said metered weft length to a temporary storage zone for collection therein; means operative during a portion of said cycle to deliver a stream of pressurized air in pulse form to the injection nozzle in contact with the weft yarn in said nozzle to deliver an air pulse across said shed, said air stream being capable of imparting to said weft yarn sufficient thrusting force to withdraw the metered out length of weft in its entirety from said storage zone and project the leading end thereof across said shed to the opposite side; means effective upon the removal of the entirety of said metered weft length from said storage zone to mechanically engage the weft yarn adjacent said storage zone to prevent said thrusting force from withdrawing additional weft yarn directly from said yarn source; and means for independently adjusting the magnitude of said imparted thrusting force and the resistance acting on the yarn upstream of said nozzle in relation to the velocity of the leading edge of said air pulse so that said weft leading end arrives at said opposite shed side substantially coincidentally with said mechanical engagement of the yarn to prevent direct withdrawal thereof from said yarn source.

72. The loom of claim 71 wherein said nozzle has a throat of minimum cross-section and a normal exit opening therein and including a cylindrical barrel of predetermined length adapted to be mounted to said nozzle downstream of said exit opening to effectively extend the length of said nozzle.

73. The loom of claim 71 including a throat and a hollow yarn feed tube passing through the nozzle from its upstream end to at least said throat with the weft end advancing through the interior of said feed tube, the position of the end of said feed tube relative to said throat being determined according to the extent of thrust to be imparted to the weft yarn by the nozzle.

74. The loom of claim 71 including means for applying a variable resistance to said weft strand upstream of said nozzle to offset in part the thrusting force applied to the weft yarn by the nozzle.

* * * * *